US008444299B2

(12) United States Patent
Chou et al.

(10) Patent No.: US 8,444,299 B2
(45) Date of Patent: May 21, 2013

(54) DIMMABLE LED BULB WITH HEATSINK HAVING PERFORATED RIDGES

(75) Inventors: Der Jeou Chou, Mesa, AZ (US); Ming Yi Chan, Taipei (TW); Yu Chen Chang, Taipei (TW)

(73) Assignee: Enertron, Inc., Tempe, AZ (US)

( * ) Notice: Subject to any disclaimer, the term of this patent is extended or adjusted under 35 U.S.C. 154(b) by 239 days.

(21) Appl. No.: 12/912,569

(22) Filed: Oct. 26, 2010

(65) Prior Publication Data

US 2011/0037387 A1 Feb. 17, 2011
US 2012/0212129 A9 Aug. 23, 2012

Related U.S. Application Data

(63) Continuation-in-part of application No. 12/236,993, filed on Sep. 24, 2008, now Pat. No. 8,317,358.

(60) Provisional application No. 60/975,109, filed on Sep. 25, 2007.

(51) Int. Cl.
*F21V 29/00* (2006.01)
*H01K 1/58* (2006.01)

(52) U.S. Cl.
USPC ..... 362/294; 362/650; 362/651; 362/249.02; 362/373; 313/46; 313/498; 313/318.04; 165/80.3

(58) Field of Classification Search
USPC ..... 313/46, 498, 512, 318.04; 362/647–649, 362/650, 651, 249.02, 294, 373, 238, 240; 165/80.3, 185
See application file for complete search history.

(56) References Cited

U.S. PATENT DOCUMENTS 2,745,895 A * 5/1956 Lideen ..... 165/80.3
5,329,996 A * 7/1994 Rosenfeld ..... 165/168
7,144,140 B2 * 12/2006 Sun et al. ..... 362/373
7,521,872 B2 * 4/2009 Bruning ..... 315/158

(Continued)

FOREIGN PATENT DOCUMENTS

CN 1341966 A 3/2002
CN 1348608 A 5/2002
CN 1404564 A 3/2003

OTHER PUBLICATIONS

LEDnovation, "LEDnovation introduces world's only A19 LED lamp for 100W incandescent and CFL replacements" Press Release, pp. 1-2, Dec. 16, 2009.

(Continued)

*Primary Examiner* — Ismael Negron
(74) *Attorney, Agent, or Firm* — Robert D. Atkins; Atkins & Associates, P.C.

(57) ABSTRACT

A light-emitting diode lamp includes a light engine, a power assembly, and a heatsink. The light engine includes a plurality of light-emitting diodes, and the power assembly includes a socket disposed at one end of the power assembly and a heat spreader plate disposed at another end of the power assembly opposite the socket. The light engine is mounted to the heat spreader plate. The power assembly further includes a power supply circuit that is electrically coupled to the socket and to the light engine. The socket is configured to electrically couple the power supply circuit to an external electrical source. The heatsink encircles the power assembly and is thermally connected to the light engine. The heatsink also includes a plurality of perforations, which are arranged to facilitate a natural convection airflow over and through the heatsink.

6 Claims, 8 Drawing Sheets

U.S. PATENT DOCUMENTS

| | | | | |
|---|---|---|---|---|
| 7,524,089 | B2 * | 4/2009 | Park | 362/294 |
| 7,581,856 | B2 | 9/2009 | Kang et al. | |
| 7,637,635 | B2 | 12/2009 | Xiao et al. | |
| 7,661,854 | B1 | 2/2010 | Yang et al. | |
| 7,677,767 | B2 | 3/2010 | Chyn | |
| 7,868,525 | B2 * | 1/2011 | Liu et al. | 313/25 |
| 7,874,710 | B2 * | 1/2011 | Tsai et al. | 362/373 |
| 8,115,395 | B2 * | 2/2012 | Horng et al. | 315/117 |
| 2009/0296387 | A1 * | 12/2009 | Reisenauer et al. | 362/235 |
| 2010/0002453 | A1 * | 1/2010 | Wu et al. | 362/373 |
| 2010/0060130 | A1 * | 3/2010 | Li | 313/46 |
| 2010/0109499 | A1 * | 5/2010 | Vilgiate et al. | 313/1 |
| 2010/0181833 | A1 * | 7/2010 | Wu | 307/36 |
| 2010/0181889 | A1 | 7/2010 | Falicoff et al. | |
| 2010/0232168 | A1 * | 9/2010 | Horng et al. | 362/373 |
| 2010/0295436 | A1 * | 11/2010 | Horng et al. | 313/46 |
| 2011/0001417 | A1 * | 1/2011 | Stekelenburg | 313/46 |
| 2011/0037368 | A1 * | 2/2011 | Huang | 313/46 |
| 2011/0101877 | A1 * | 5/2011 | Zhan et al. | 315/206 |
| 2011/0181165 | A1 * | 7/2011 | Lin et al. | 313/46 |
| 2011/0204790 | A1 * | 8/2011 | Arik et al. | 315/113 |
| 2011/0221322 | A1 * | 9/2011 | Lai | 313/46 |
| 2012/0014098 | A1 * | 1/2012 | Breidenassel et al. | 362/249.01 |
| 2012/0161602 | A1 * | 6/2012 | Yu et al. | 313/46 |

OTHER PUBLICATIONS

LEDnovation, EnhanceLite LED Retrofit Lamp, product specification, 1 page, 2010.

Luminaire Testing Laboratory, Inc., Photometrics, pp. 1-5, Oct. 9, 2009.

* cited by examiner

DIMMABLE LED BULB WITH HEATSINK HAVING PERFORATED RIDGES

CLAIM TO DOMESTIC PRIORITY

The present application claims priority from, and is a continuation-in-part of, U.S. application Ser. No. 12/236,993, filed on Sep. 24, 2008, which claims benefit of Provisional Application No. 60/975,109, filed Sep. 25, 2007.

FIELD OF THE INVENTION

The disclosure relates generally to lighting products, and, specifically, to dimmable light emitting diode (LED) bulbs with natural and/or forced convection cooling.

BACKGROUND OF THE INVENTION

The incandescent light bulb is commonly found in a bulbous, pear-shaped configuration. The pear-shaped configuration is popularly referred to by the American National Standards Institute (ANSI) as the "A" shape.

The "A" terminology carries with it a numerical reference following the "A," such as "A19." The numerical reference following the "A" represents the widest part of the lamp envelope, in units of ⅛ (0.125) of an inch. Thus, an incandescent bulb described as "A19" indicates that the widest part of the lamp envelope is (19×0.0125), or 2.375 inches in diameter. The overall length of the A19 form factor is 4.25 inches. A19 incandescent bulbs are frequently designed to use 45, 60, 75, or 100 Watts (W) of energy.

LEDs have been used for decades in applications requiring relatively low-energy indicator lamps, numerical readouts, and the like. In recent years, however, the brightness and power of individual LEDs have increased substantially, resulting in the availability of 1 watt, 3 watt, and 5 watt devices.

While small, LEDs exhibit a high efficacy and life expectancy as compared to traditional lighting products. A typical incandescent bulb has an efficacy of 10 to 12 lumens per watt, and lasts for about 1,000 to 2,000 hours; a general fluorescent bulb has an efficacy of 40 to 80 lumens per watt, and lasts for 10,000 to 20,000 hours; a typical halogen bulb has an efficacy of 15 lumens and lasts for 2,000 to 3,000 hours. In contrast, LEDs can emit more than 100 lumens per watt with a life-expectancy of about 100,000 hours.

Thus, LED lighting sources can provide a brilliant light in many settings. LED lights are efficient, long-lasting, cost-effective, and environmentally friendly. For the above reasons, LED lighting is rapidly becoming the light source of choice in many applications.

Because of the many advantages associated with LED light sources, there remains continued interest in replacing traditional lighting products, such as incandescent and compact fluorescent (CFL) bulbs, with a corresponding LED lamp that has the same form, fit, and function. For example, for a particular lighting fixture that uses an A19 bulb, it is desirable to "swap out" a 60 W incandescent bulb with an LED lamp that emits approximately the same amount of light but has a much longer life expectancy and reduced operating cost.

The term "Energy Star" refers to the U.S. government's energy performance rating system program that is jointly managed by the U.S. Department of Energy (DOE) and the U.S. Environmental Protection Agency (EPA). According to Energy Star guidelines, a 40 W incandescent bulb nominally emits 450 lumens, while a 60 W incandescent bulb nominally emits 800 lumens. Thus, to be considered a valid replacement for a 60 W incandescent bulb, an LED lamp should emit at least 800 lumens.

LED light sources rely on LED light engines to generate the light energy that is emitted from the light source. The LEDs are electrically interconnected and a power supply energizes the LEDs via connection terminals connected to the substrate.

Today, a typical efficacy for a warm (color temperature of about 2600 to 3000 degrees K) LED light engine is around 100 lumens/W. Assuming optical, thermal, and electrical losses of about 15% each, the overall efficacy for an LED lamp incorporating such an emitter is about 60 lumens/W. Thus, the LED lamp would require about 10 W to generate a light output of 600 lumens, or about 13.3 W to generate a light output of 800 lumens. If 25% of the electricity is converted to light energy and the other 75% to heat energy, the LED lamp produces about 10 W of heat energy in order to achieve an output of 800 lumens. As the above example illustrates, an LED light engine typically generates a substantial amount of heat energy.

Heat dissipation and weight are important design considerations. Heatsinks tend to be large and heavy. It is difficult to accurately control the thickness of heatsinks leading to excessive weight. Heatsinks also add substantially to the overall cost of an LED lamp.

SUMMARY OF THE INVENTION

In one embodiment, the present invention is an LED lamp comprising a light engine including a plurality of LEDs and power assembly. The power assembly includes a socket disposed at one end of the power assembly and power supply circuit that is electrically coupled to the socket and to the light engine. The socket is configured to electrically couple the power supply circuit to an external electrical source. A heat spreader plate is disposed at another end of the power assembly opposite the socket. The light engine is mounted to the heat spreader plate. A heatsink encircles the power assembly and that is thermally connected to the light engine. The heatsink includes a plurality of perforations arranged to facilitate a natural convection airflow over and through the heatsink.

In another embodiment, the present invention is an LED lamp comprising an optical assembly including a light engine. A power assembly includes a power supply circuit configured to convert an input voltage into a first output voltage that is provided to the light engine. A thermal assembly includes a heatsink that encircles the power assembly and that is mechanically coupled to the power assembly. The heatsink includes a plurality of perforations in a wall of the heatsink. The perforations is arranged to facilitate a natural convection airflow over and through the heatsink.

In another embodiment, the present invention is a method of manufacturing an LED lamp comprising the steps of stamping a sheet of material to form a heatsink having a plurality of perforations and a plurality of corrugations, providing a power assembly, and mechanically coupling the power assembly to the heatsink by placing the power assembly of the LED lamp inside an empty space within the heatsink. The power assembly includes a power supply circuit configured to convert an AC input voltage into a first output voltage.

In another embodiment, the present invention is a method of manufacturing an LED lamp comprising the steps of stamping a sheet of material to form a heatsink having a plurality of corrugations and a plurality of perforations, and positioning a power assembly of the LED lamp within the heatsink such that the heatsink is mechanically coupled to the power assembly. The corrugations and perforations is configured to facilitate a natural convection airflow over and through the heatsink.

BRIEF DESCRIPTION OF THE DRAWINGS

The following Figures, which illustrate aspects of one or more example embodiments, are presented for illustrative purposes and do not necessarily limit the scope of the claims. In order to more clearly explain particular aspects of example embodiments, the Figures may not be drawn to scale.

DETAILED DESCRIPTION OF THE DRAWINGS

Figure 1:
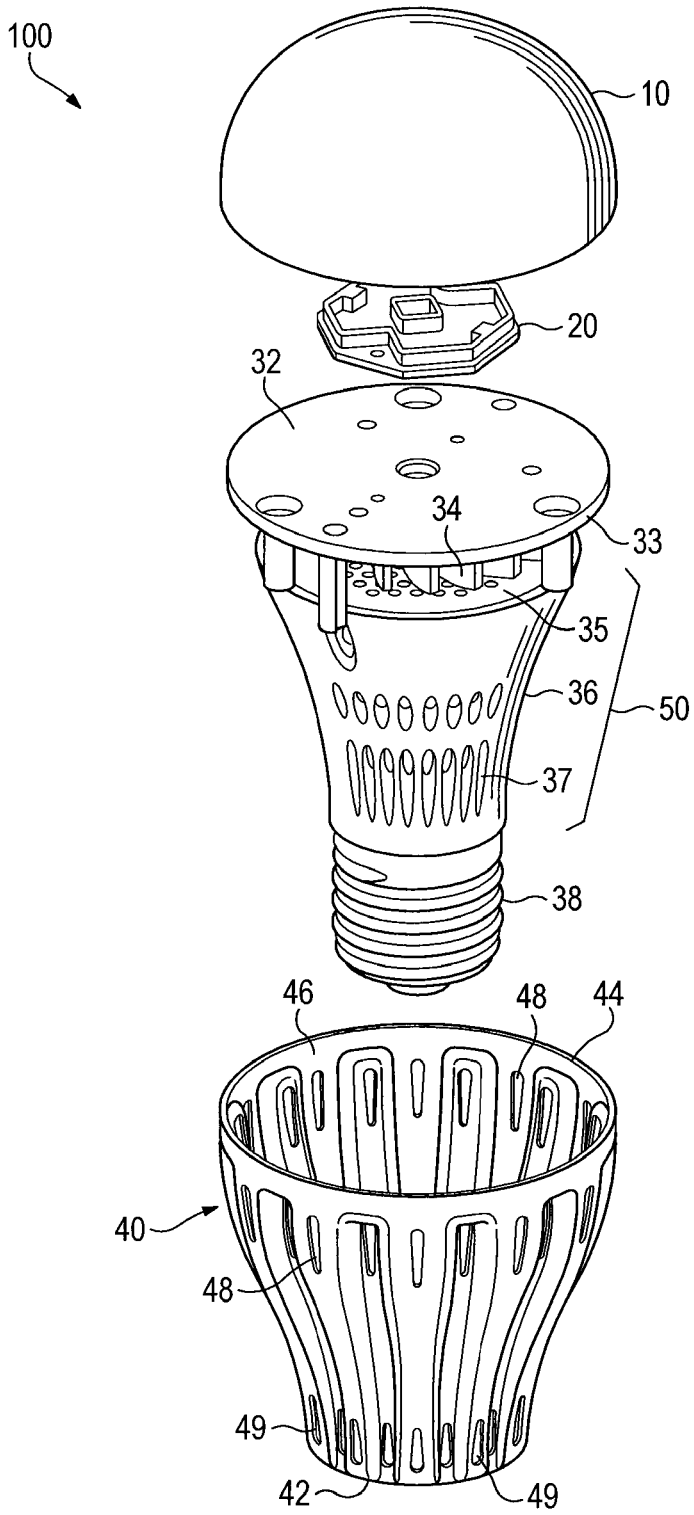
FIG. 1 is an exploded, perspective view diagram illustrating some components of an LED lamp.

Aspects of one or more example embodiments are described in the following disclosure with reference to the Figures, in which like numerals represent the same or similar elements. While the described example embodiments include the best mode, it will be appreciated by those skilled in the art that it is intended to cover alternatives, modifications, and equivalents as may be included within the spirit and scope of the invention as set forth and defined by the appended claims and their equivalents as supported by the following disclosure and drawings.

An important design aspect of LED lighting is the need for efficient heat dissipation, as well as lightweight construction. Excessive heat minimizes the lifespan of LED light sources. In some cases, excessive heat also modifies the operating characteristics of an LED light source. For example, because the light generation properties of many LED light sources are at least partially governed by temperature, a significant change in the ambient temperature surrounding an LED light source can cause a change in the correlated color temperature (CCT) of white light emitted from the device. Accordingly, a thermally efficient LED lamp minimizes the CCT shift and prolongs the lifespan of the light source contained within the lamp.

Keeping in mind these considerations, for some bulb shapes, such as the A19, it has proven challenging to achieve an LED lamp that generates more than 800 lumens while effectively extracting heat energy from the LED light engine. The challenge arises because the A19 shape possesses less than about 100 cm2 for dissipating heat from the LED light engine through natural convection. One approach has been to incorporate into the LED lamp one or more finned heatsinks, that is, heatsinks having finned structures for dissipating heat energy into the environment. Finned heatsinks can be formed by stamping, extruding, casting, or molding metal into the desired shape of the heatsink.

It is possible to reduce the size, weight, and manufacturing cost of the heatsink in an LED lamp while still effectively dissipating heat energy by incorporating a forced convection element (e.g., a cooling fan) into the body of the LED lamp and/or by utilizing a lightweight heatsink that includes a plurality of vent holes.

When forced convection cooling and/or a heatsink including vent holes are used in an LED lamp, the heatsink can be made relatively lightweight and inexpensively manufactured by using a stamping process, such as a so-called "deep draw" stamping process. A lightweight heatsink manufactured through a stamping process has a wall that includes corrugations, as well as perforations or vent holes penetrating the wall of the heatsink. Both the presence of the corrugations and the perforations encourage effective cooling airflow passage over and through the heatsink, whether the airflow arises solely from natural convection effects or from both natural convection and forced convection, such as by using a fan. Additionally, a dimmable power supply for an LED lamp with forced convection cooling can achieve delivery of constant airflow from the cooling fan regardless of the dimming level.

Figure 2:
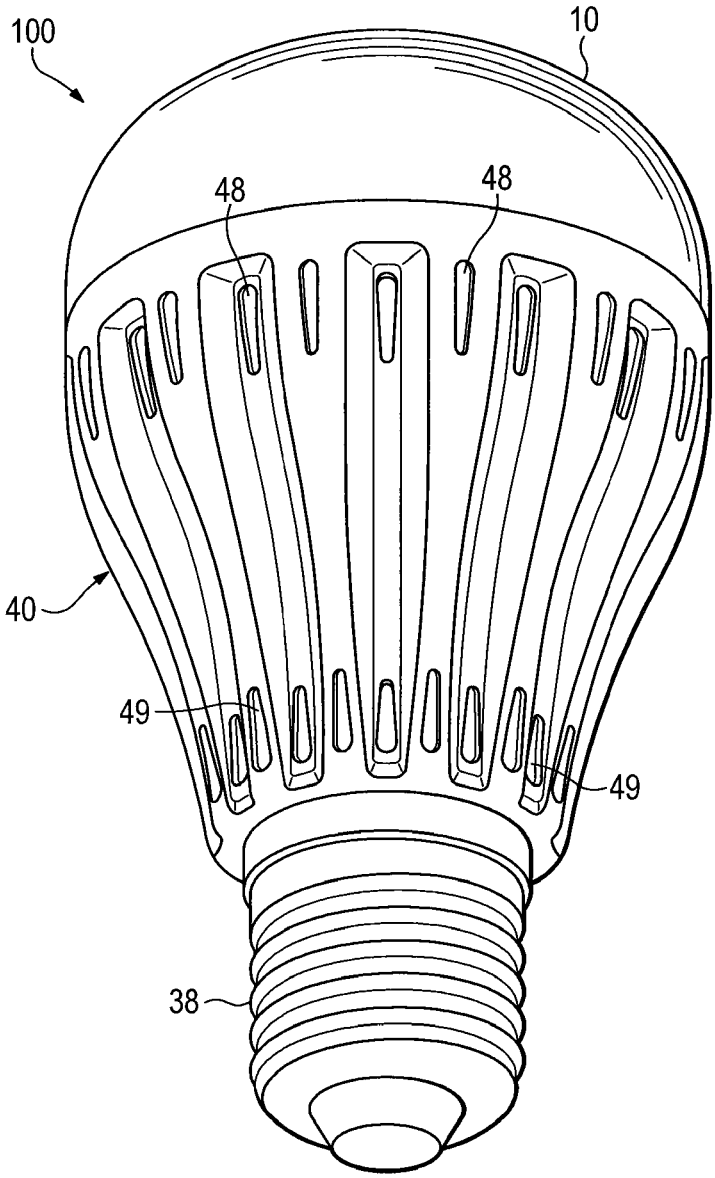
FIG. 2 is a perspective view diagram illustrating the assembled components of the LED lamp of FIG. 1.

FIG. 1 is an exploded view diagram illustrating some components of an LED lamp 100. FIG. 2 is a perspective view diagram illustrating the assembled components of the LED lamp 100 of FIG. 1.

Referring to FIGS. 1 and 2, LED lamp 100 includes an optical envelope 10, LED light engine 20, heat spreader plate 32 having outer circumferential surface 33, fan 34, power supply housing 36 having perforations 37, socket 38, and heatsink 40. For convenience, heatsink 40, heat spreader plate 32, and fan 34 can be referred to as a thermal assembly. Optical envelope 10 and LED light engine 20 can be referred to as an optical assembly, while power supply housing 36 and socket 38 can be referred to as a power assembly 50. Power assembly 50, the optical assembly, and the thermal assembly of LED lamp 100 can each include additional components in addition to the components shown in FIGS. 1 and 2.

Socket 38 is configured to connect to a light-bulb socket for connecting LED lamp 100 to an electricity source. Socket 38 is an E26/E27 bulb socket, GU24 socket, or any other type of connector. Depending on the application, the electricity source can be 120 Volts, alternating current (VAC), 220 VAC, 277 VAC, or other alternating current (AC) source or a direct current (DC) power source. In alternative embodiments, however, socket 38 can be any socket for connecting to a power supply for supplying electricity to power assembly 50 of LED lamp 100.

As shown in FIGS. 1 and 2, heatsink 40 encircles an empty space, and upon assembly of LED lamp 100, power assembly 50 is placed within the empty space such that socket 38 protrudes from a smaller circular opening 42 at one end of the heatsink. Heatsink 40 and heat spreader plate 32 are sized based on A19 form and shape such that when the power assembly is positioned inside the heatsink, an outer circumferential surface 33 of heat spreader plate 32 contacts an inner circumferential surface 46 of the heatsink near a larger circular opening 44 in the heatsink. Heatsink 40 and heat spreader plate 32 are thermally and mechanically connected power assembly 50.

In some embodiments, power assembly 50 and heatsink 40 are held together by friction coupling between inner circumferential surface 46 of heatsink 40 and outer circumferential surface 33 of heat spreader plate 32. In other embodiments, however, a thermally conductive adhesive material or solder is used to join inner circumferential surface 46 of heatsink 40 and outer circumferential surface 33 of heat spreader plate 32.

In other example embodiments, there can be other contact points between heatsink 40 and power assembly 50 besides the one described above. For example, heatsink 40 and power supply housing 36 can be sized such that an outer circumferential surface of power supply housing 36 contacts an inner circumferential surface of heatsink 40 near smaller circular opening 42.

Heatsink 40 includes or is composed of one or more thermally conductive materials such as, for example, a metal such as copper (Cu) or aluminum (Al), or a carbon composite material such as graphite. As shown in FIGS. 1 and 2, the wall of heatsink 40 includes a number of folds and ridges, or corrugations, running longitudinally down the heatsink. The corrugations in the wall of heatsink 40 are substantially perpendicular to a pair of parallel planes that include larger circular opening 44 and smaller circular opening 42. Corrugations in a wall of heatsink 40 encourage natural and/or forced convection airflow over and through heatsink 40. Advantageously, and as explained in greater detail below, corrugations in a wall of heatsink 40 can be advantageously obtained through a stamping process such as "deep draw" stamping.

As shown in FIGS. 1 and 2, the corrugations in heatsink 40 are substantially wider near larger circular opening 44 than they are near smaller circular opening 42. As shown, an outer envelope of heatsink 40 conforms to the ANSI "A" form factor, and in some embodiments an outer surface of heatsink 40 conforms to the ANSI "A19" form factor. It should be clear, however, that alternative embodiments include a heatsink that is shaped differently depending on the particular application.

Additionally, heatsink 40 includes a number of vent holes or perforations 48 and 49 that penetrate the heatsink itself. As shown, the shape of perforations 48 and 49 resemble that of an elongated tear drop, where a width of a perforation is generally larger at one end of the perforation than at the other end. In other example embodiments, a shape of perforations 48 and 49 can be circular, oval, oblong, rectangular, triangular, parabolic, or any other desired shape, although the elongated tear drop shape illustrated in FIGS. 1 and 2 has been found to be particularly effective. Alternative embodiments utilize perforations 48 and 49 having different shapes, for example, some perforations are circular and some perforations are oval, or some other combination.

Perforations 48 and 49 are arranged in two rows, with perforations 48 arranged in one row near larger circular opening 44 and perforations 49 arranged in another row near smaller circular opening 42. As shown in FIGS. 1 and 2, perforations 48 and 49 are spaced uniformly around a circumference of heatsink 40, such that a first perforation 48 or 49 is disposed at a top, or peak, of a corrugation, and perforations 48 or 49 immediately adjacent to the first perforation in the same row are each disposed at a bottom, or trough, of a corrugation. In order to prevent objects from being inserted through the perforations, which otherwise can lead to safety concerns or damage to the LED lamp 100, a maximum width of perforations 48 and 49 should be no greater than about 2 millimeters.

When LED lamp 100 is assembled, the row of perforations 48 near larger circular opening 44 is substantially aligned with fan 34. Fan 34 is arranged such that, when operational, it advantageously forces cooling air over heatsink 40 and through perforations 48 and 49, thereby improving heat dissipation into the external surrounding. In another embodiment, fan 34 is placed aligned with perforations 49 near small circular opening 42.

It should be emphasized that some embodiments do not require a forced cooling element, such as fan 34. In some embodiments, such as a lower power unit, the presence of perforations 48 and 49 in heatsink 40 provide a path for cooling airflow that arises due solely to natural convection effects, such as the so-called "chimney" effect. Thus, perforations 48 and 49 increase the effectiveness of heatsink 40 by providing an additional airflow path that encourages natural convection over and through heatsink 40.

The position of the rows of perforations 48 and 49, with one row adjacent to the larger circular opening 44 and one row adjacent to the smaller circular opening 42, ensures that the path of cooling air flow inside the heatsink 40 is maximized, reducing the size of any region where air could be trapped within the heatsink. The corrugations of the heatsink 40, the perforations 48 and 49 in the heatsink, the shape of the perforations, and the position of the perforations all contribute to an effective and aerodynamic cooling airflow passage through the heatsink.

At this point, it should be mentioned that forced convection elements, such as fan 34, need not be present in some example embodiments. Lightweight, stamped heatsinks such as heatsink 40 can also be advantageously used in LED lamps having no fans. The perforations 48 and 49 in the wall of heatsink 40 and the corrugations in the wall of heatsink 40 will still encourage natural convection airflow over and through heatsink 40. In some applications where less lumens are required, a lightweight stamped heatsink, such as heatsink 40, alone is enough for effective dissipation of heat energy.

As explained in further detail below, heatsink 40 is manufactured by a stamping process, where relatively thin sheets of thermally conductive material are stamped to form the structure of the heatsink. Because heatsink 40 advantageously includes perforations 48 and 49 to encourage forced and/or natural convection airflow over and through heatsink 40 to improve the efficiency of heat dissipation, heatsink 40 of LED lamp 100 need not be as massive as finned heatsinks. As mentioned above, finned heatsinks are often manufactured using extrusion, die casting, or molding processes, because the finned heatsinks typically require a larger surface area to obtain an effective heat transfer.

Thus, because heatsink 40 encourages airflow (forced or natural) with perforations 48 and 49, and require less material to effectively dissipate heat than a finned heatsink, example embodiments take advantage of a stamping process, such as a deep draw process, to press relatively thin sheets of thermally conductive material into a desired shape. The thin thermally conductive material reduces weight. Using a stamping process to manufacture heatsink 40 requires less material and is less weight as compared to manufacturing a finned heatsink using an extrusion, die casting, or molding process.

Light engine 20 is attached to heat spreader plate 32, and in some embodiments a thermally conductive material, such as thermal grease, thermal interface pad, or phase change pad, is deposited between light engine 20 and heat spreader plate 32 to improve heat transfer between light engine 20 and heat spreader plate 32. Heat spreader plate 32 is composed of or includes a thermally conductive material or materials. Thus, heatsink 40 is thermally connected to light engine 20 via heat spreader plate 32, and heat energy is easily conducted from light engine 20 to heatsink 40.

An optional optical envelope 10 is mounted to heatsink 40 using a friction coupling, fastener, adhesive, or other attachment mechanism. Optical envelope 10 can be clear or coated with one or more light-diffusing materials. In one embodiment, the coating diffuses the intensive spotlight formed by light engine 20 into a relatively smooth light source. Depending upon the application, optical envelope 10 is transparent, translucent, or frosty and includes polarizing filters, colored filters, or additional lenses such as concave, convex, planar, "bubble," and Fresnel lenses. If light engine 20 generates light having a plurality of distinct colors, optical envelope 10 is configured to diffuse the light to provide sufficient color blending. In a further alternative embodiment, a reflecting surface is placed on heat spreader plate 32 and surrounds light engine 20 to reflect the light emitted from light engine 20 away from heat spreader plate 32 and towards the transparent or translucent portion of optical envelope 10.

As shown in FIG. 2, an overall shape of the assembled LED lamp 100 generally conforms to the ANSI "A" form factor. According to some embodiments, an overall shape of the LED lamp 100 conforms to the ANSI "A19" form factor. Depending on the application, the overall shape of alternative embodiments can be altered to fit the particular design need.

Figure 3:
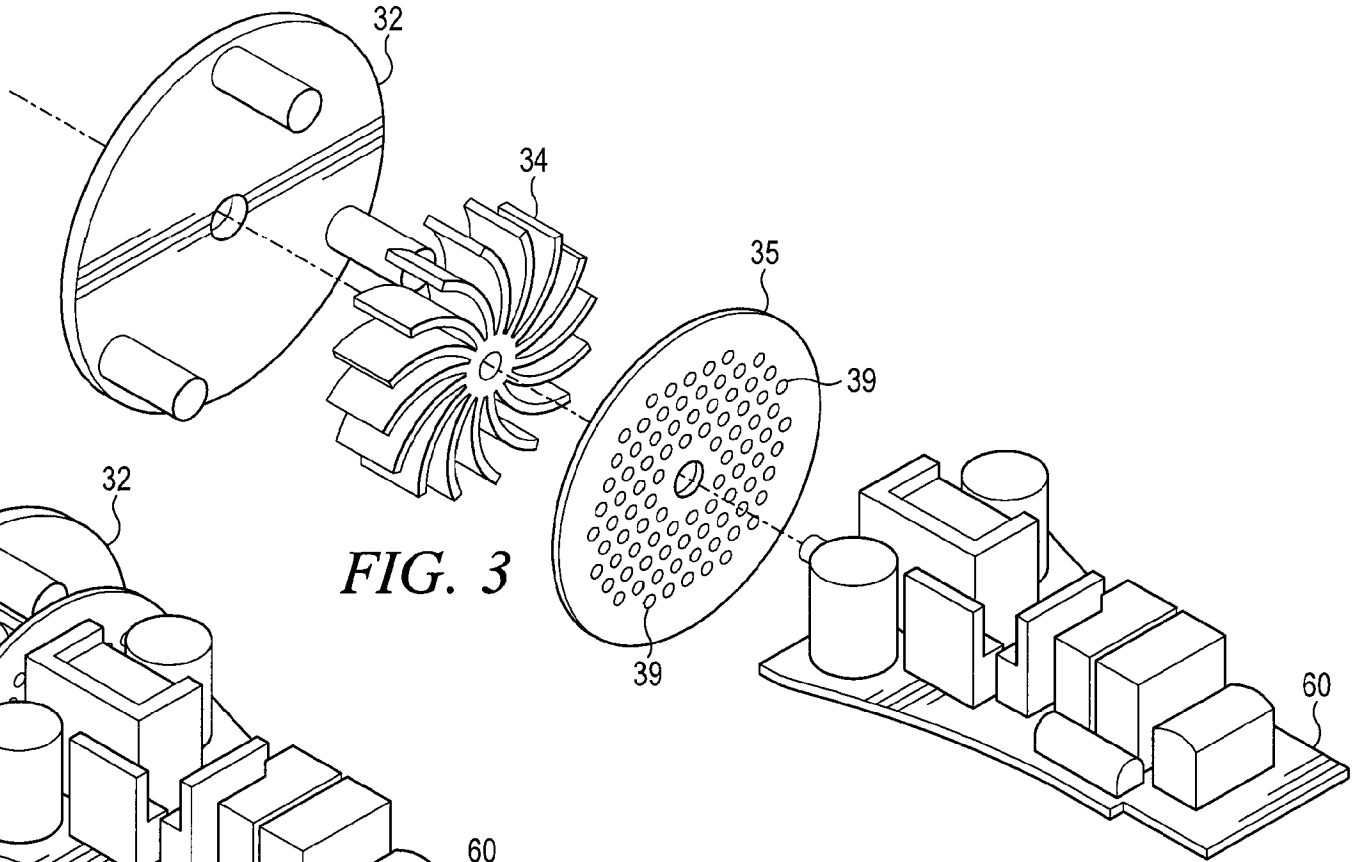
FIG. 3 is an exploded, perspective view diagram illustrating in further detail some of the components found in the power assembly and the thermal assembly of the LED lamp of FIG. 1.
Figure 4:
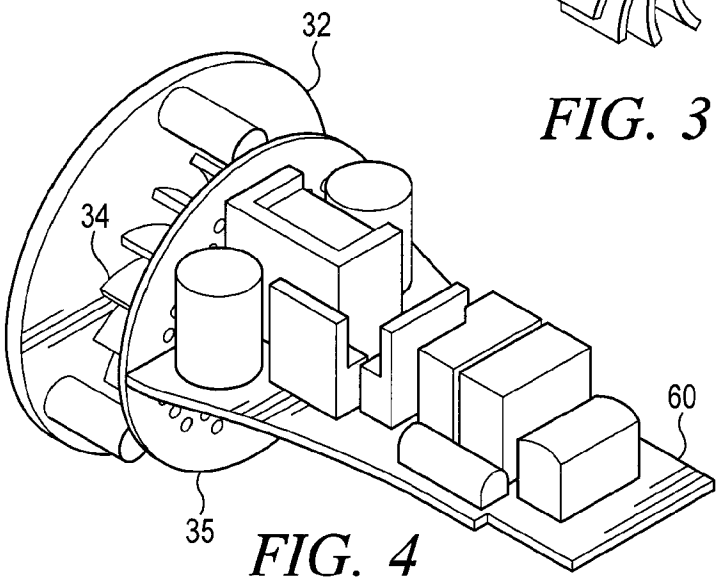
FIG. 4 is a perspective view diagram illustrating the assembled components of FIG. 3.

FIG. 3 is an exploded, perspective view diagram illustrating in further detail some of the components found in the power assembly 50 and the thermal assembly of the LED lamp of FIG. 1. FIG. 4 is a perspective view diagram illustrating the assembled components of FIG. 3. For clarity, not all components of power assembly 50 are illustrated in FIGS. 3 and 4. For example, power supply housing 36 and socket 38, which were illustrated in FIG. 1, do not appear in FIGS. 3 and 4.

Referring to FIGS. 3 and 4, a thermal assembly of LED lamp 100 includes heat spreader plate 32, fan 34, and fan base 35 having ventilation holes 39. Power assembly 50 includes a circuit board 60, as well as other discrete circuit components and/or integrated circuit (IC) components mounted or formed on the circuit board. These discrete and/or IC components include, for example, resistors, capacitors, inductors, diodes, fuses, and transistors, which together constitute other circuits, such as, for example, a dimmable power supply circuit. Details of several dimmable power supply circuits suitable for implementing example embodiments are presented in greater detail below.

Circuit board 60 is attached to circular fan base 35 at a substantially right angle. The fan speed at which fan 34 revolves is controlled by the input voltage that is applied to the fan motor. As shown, fan 34 has fan blades that can be axial, centrifuge, straight, and centrifuge twisted.

Referring to FIGS. 1, 2, and 3, when LED lamp 100 is assembled and fan 34 is operational, the air is pushed by the fan through perforations 48 on heatsink 40 to outside, therefore creating a negative air pressure inside the lamp, thus a cooling airflow can enter from perforation 49, flow through holes 37 of power supply housing 36 and ventilation holes 39 of fan base 35, then enter the power supply chamber.

Some of the forced convection airflow can follow an alternative path, which includes being drawn into heatsink 40 via perforations 48, then moving between heatsink 40 and power supply housing 36 towards the smaller end of the heatsink, and then exiting heatsink 40 via perforations 49.

Figure 5:
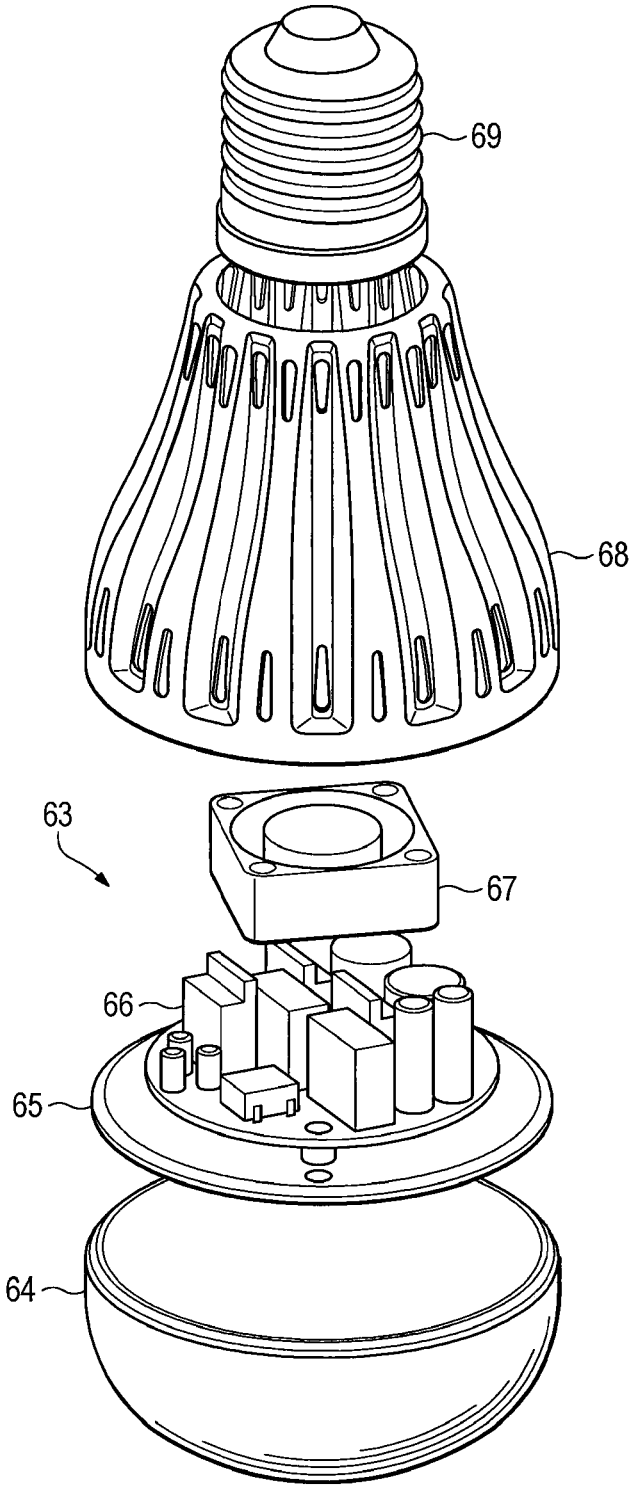
FIG. 5 is an exploded, perspective view diagram illustrating an alternate embodiment of the components of an LED lamp.

FIG. 5 shows an alternate embodiment of LED lamp 63 including an optical envelope 64, LED light engine (not shown), heat spreader plate 65, power supply assembly 66, fan and motor assembly 67, power supply housing (not shown), heatsink 68, and E26/E27 socket 69. Heatsink 68 encircles an empty space, and upon assembly of LED lamp 63, power supply assembly 66 is placed within the empty space such that socket 69 protrudes from a smaller circular opening at one end of the heatsink. Heatsink 68 and heat spreader plate 65 are sized such that when power supply assembly 66 is positioned inside the heatsink, an outer circumferential surface of heat spreader plate 65 contacts an inner circumferential surface of the heatsink near a larger circular opening in the heatsink. The contact between heatsink 68 and heat spreader plate 65 thermally connects the LED engine and power supply assembly 66 to the heatsink.

Heatsink 68 includes or is composed of one or more thermally conductive materials such as, for example, a metal such as Cu or Al, or a carbon composite material such as graphite. The wall of heatsink 68 includes a number of folds and ridges, or corrugations, running longitudinally down the heatsink. Corrugations in the wall of heatsink 68 encourage natural and/or forced convection airflow over and through the heatsink.

The LED engine is attached to heat spreader plate 65, and in some embodiments a thermally conductive material, such as thermal grease, thermal interface pad, or phase change pad, is deposited between the LED engine and heat spreader plate 65 to improve heat transfer. Heat spreader plate 65 is composed of or includes a thermally conductive material or materials. Thus, heatsink 68 is thermally connected to the LED engine via heat spreader plate 65, and heat energy is easily conducted from the LED engine to the heatsink.

An optional optical envelope 64 is mounted to heatsink 68 using a friction coupling, fastener, or other attachment mechanism. Optical envelope 64 can be clear or coated with one or more light-diffusing materials. In one embodiment, the coating diffuses the intensive spotlight formed by the LED engine into a relatively smooth light source. Depending upon the application, optical envelope 64 is transparent, translucent, or frosty and includes polarizing filters, colored filters, or additional lenses such as concave, convex, planar, "bubble," and Fresnel lenses. If the LED engine generates light having a plurality of distinct colors, optical envelope 64 is configured to diffuse the light to provide sufficient color blending. In a further alternative embodiment, a reflecting surface surrounds the LED engine and reflects the light emitted from the LED engine away from heat spreader plate 65 and towards the transparent or translucent portion of optical envelope 64.

Fan and motor assembly 67 is powered by power supply assembly 66. When LED lamp 63 is assembled, fan and motor assembly 67 is arranged such that, when operational, it advantageously forces cooling air over heatsink 68, thereby improving heat dissipation into the external surroundings. In this embodiment, airflow enters and exits from perforations in the power supply assembly.

Figure 6:
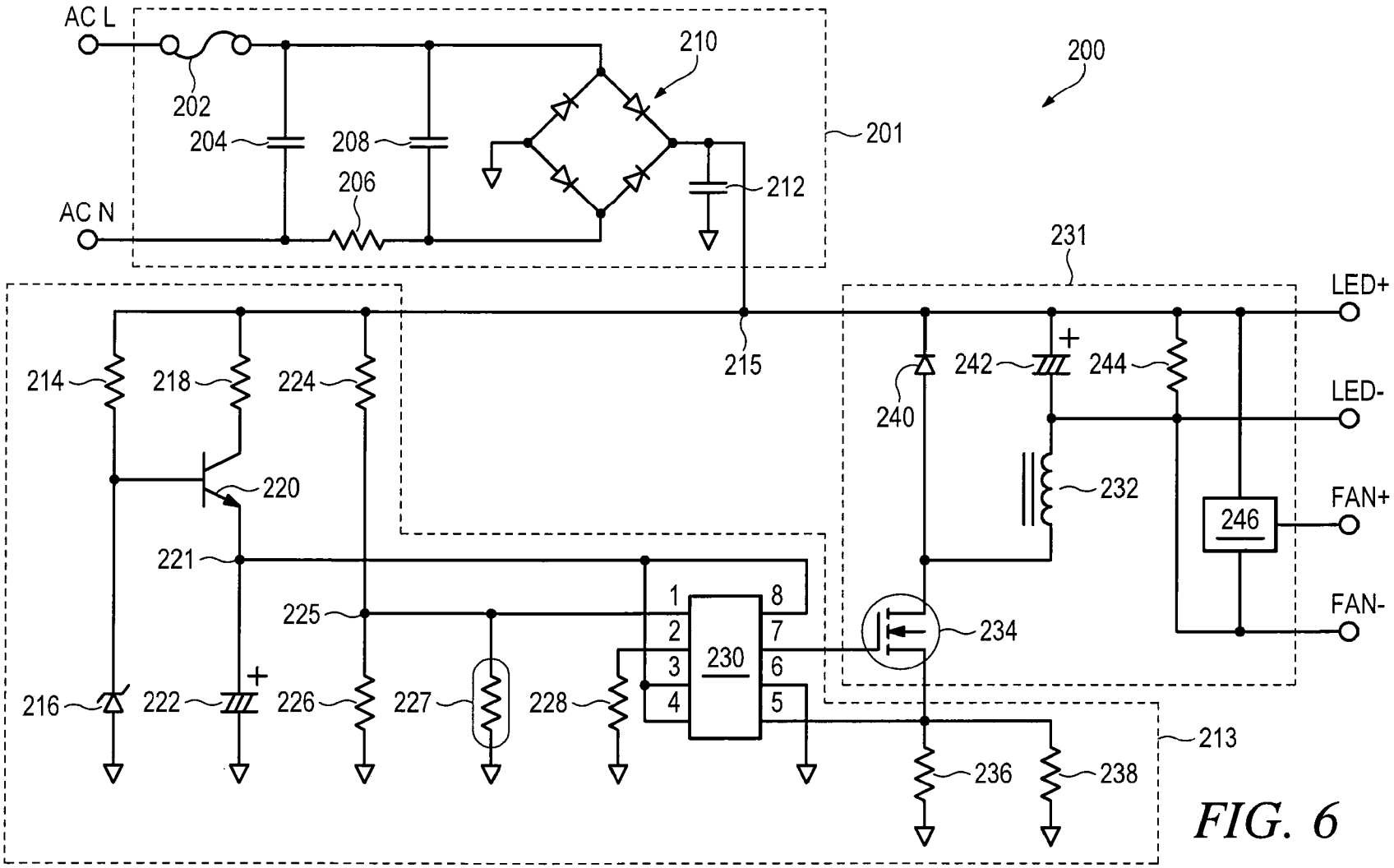
FIG. 6 is a circuit diagram illustrating a dimmable power supply circuit suitable for the power assembly of the LED lamp of FIG. 1.

FIG. 6 is a circuit diagram illustrating a dimmable power supply circuit 200 suitable for implementing in power assembly 50 of LED lamp 100 of FIG. 1. The numerous circuit elements constituting dimmable power supply circuit 200 are disposed on circuit board 60 in FIG. 3 of power assembly 50, and take the form of discrete circuit elements or IC packages. The conductive elements such as bumps, traces, or wiring that are used to electrically connect the various circuit elements are not shown on circuit board 60 of FIG. 3.

Turning now to FIG. 6, dimmable power supply circuit 200 are arbitrarily subdivided, for convenience and ease of explanation, into several different stages. These stages are referred to as conversion stage 201, control stage 213, and output stage 231.

A main component of conversion stage 201 is a bridge rectifier 210. Bridge rectifier 210 includes four diodes. A cathode of a first diode is coupled to an anode of a second diode, a cathode of the second diode is coupled to an anode of a third diode, a cathode of the third diode is coupled to an anode of a fourth diode, and a cathode of the fourth diode is coupled to an anode of the first diode. In some embodiments, bridge rectifier 210 comprises a four-pin IC package such as DB107, a 1.0 Amperes (A) glass passivated bridge rectifier manufactured by Diodes Incorporated.

Bridge rectifier 210 thus forms four circuit nodes, with one circuit node disposed between each of the diodes. A first node of the bridge rectifier 210 is coupled to ground, while a second node of the bridge rectifier 210 is coupled to circuit node 215, which forms the LED+ output of output stage 231. Output stage 231 will be described in greater detail below.

Conversion stage 201 further includes a resistor 206, which is coupled between a third node of bridge rectifier 210 and the ACN input. Conversion stage 201 further includes a fuse 202, which is coupled between a fourth node of bridge rectifier 210 and the ACL input.

Conversion stage also includes capacitors 204, 208, and 212. Capacitor 212 is coupled between the second node of bridge rectifier 210 and ground. Capacitor 204 is coupled between the fourth node of bridge rectifier 210 and the ACN input. Capacitor 208 is coupled between the third node of bridge rectifier 210 and the ACL input.

Functionally speaking, conversion stage 201 converts an input of about 120 VAC to about 277 VAC appearing across the inputs ACL and ACN into a DC output at circuit node 215, which is coupled to the LED+ output of dimmable power supply circuit 200. In conversion stage 201, capacitors 204, 208 and resistor 206 form a resistor capacitive (RC) filter between the ACL and ACN inputs and the bridge rectifier 210. Capacitor 212, which is coupled between circuit node 215 and ground, performs additional filtering. The combination of the RC filter comprising capacitors 204, 208 and resistor 206 along with capacitor 212 coupled between circuit node 215 and ground provides a smooth dimming function for conversion stage 201. That is, a voltage at circuit node 215 is smoothly increased or decreased in response to a corresponding increase or decrease in an AC input across ACL and ACN.

An AC input across input terminals ACL and ACN can be controlled using an external dimming circuit that utilizes forward phase, reverse phase or sine wave control to reduce or increase a magnitude of the AC input. The forward phase, reverse phase, or sine wave control dimming techniques are typically implemented with silicon controlled rectifiers (SCR), Triac, pulse width modulation (PWM), or insulated gate bipolar transistor (IGBT).

In forward phase control, the dimmer circuit allows only portions of the AC cycle through to the load. For example, an SCR and Triac can be used to control the intensity of light by varying the switch ON point of the lamp current each half cycle (forward phase). In reverse phase, an IGBT gradually varies the current to reduce the filament noise in a similar fashion as a forward phase dimmer without the need of a choke. Alternatively, a pure sine wave output with variable amplitude can be implemented to control lighting levels use transistors to slice the mains into pulses, vary the current using PWM, and average the result, which produces a continuous, variable amplitude smooth sine wave.

Next, control stage 213 of dimmable power supply circuit 200 is described. Control stage 213 includes an LED driver 230 in the form of an 8-pin IC package. In the illustrated embodiments, LED driver 230 is a high-power LED driver, part number MLX10803, which is manufactured by Melexis.

Control stage 213 includes resistor 214 and zener diode 216, which are coupled between circuit node 215 and ground. Control stage 213 additionally includes resistor 218, a NPN bipolar junction transistor (BJT) 220, and a capacitor 222. One end of resistor 218 is coupled to circuit node 215, while another end of resistor 218 is coupled to a collector of transistor 220. The base of transistor 220 is coupled to the cathode of zener diode 216, while capacitor 222 is coupled between an emitter of transistor 220 and ground.

Control stage 213 additionally includes resistor 224 and resistor 226, which are coupled between circuit node 215 and ground. Circuit node 225 is disposed between resistors 224 and 225. Control stage 213 additionally includes a Negative Temperature Coefficient (NTC) resistor, or thermistor 227, coupled between circuit node 225 and ground. As temperature increases, a resistance of thermistor 227 decreases.

Control stage 213 additionally includes resistors 236 and 238, which are coupled in parallel between pin 5 of LED driver 230 and ground. Control stage 213 further includes resistor 228, which is coupled between pin 2 of LED driver 230 and ground.

Pin 1 of LED driver 230 is coupled to circuit node 225. As mentioned above, pin 2 of LED driver 230 is coupled to resistor 228. Pins 3, 4, and 8 of LED driver 230 are all coupled to circuit node 221 at the emitter of transistor 220. Pin 5 of LED driver 230 is coupled to resistors 236 and 238 and to a source of transistor 234, which is part of output stage 231 and will be described in further detail below. Pin 6 of LED driver 230 is coupled to ground, and pin 7 of LED driver 230 is coupled to a gate of transistor 234.

When dimmable power supply circuit 200 is operational, a voltage across zener diode 216 remains relatively constant, as does a voltage across a base-emitter junction of transistor 220. The voltage at circuit node 221 is equal to the voltage across zener diode 216 less the base-emitter voltage of transistor 220.

As indicated above, pins 3, 4, and 8 of LED driver 230 are coupled to each other and also to the emitter of transistor 220 at node 221. LED driver 230 uses the voltage at node 221 as a source voltage (Vs) to derive an internal operating voltage. LED driver 230 is capable of using the voltages on pins 3 and 4 to perform temperature regulation functions.

As will be discussed in further detail when output stage 231 is described, when transistor 234 is "on," current flows through transistor 234 and through the parallel-connected combination of resistors 236 and 238. LED driver 230 uses pin 5, which is coupled to resistors 236 and 248 and to the source of transistor 234, to detect an overcurrent situation and is capable of placing transistor 234 is an "off" state when an overcurrent situation is detected.

Pin 2 of LED driver 230 is coupled to resistor 228. By choosing an appropriate resistance for resistor 228, resistor 228 is used to set an oscillation frequency for an internal oscillator within LED driver 230. Pin 1 of LED driver 230 is coupled to circuit node 225. A voltage at circuit node 225 functions as a reference voltage that sets a maximum duty cycle for a switching signal that is output from LED driver 230 at pin 7. The switching signal that is output from pin 7 of LED driver 230 is coupled to drive the gate of transistor 234.

When dimmable power supply circuit 200 is operational, resistor 224, resistor 226, and thermistor 227 function as a temperature-dependent voltage divider which produces a voltage at circuit node 225 that is a fraction of the voltage that appears at circuit node 215. The specific fraction is determined by a ratio of a resistance of the parallel combination of resistor 226 and thermistor 227 to a sum of the resistances of resistor 224 and the parallel combination of resistor 226 and thermistor 227.

Thermistor 227 is a negative temperature coefficient resistor. Thus, as temperature increases, a resistance of thermistor 227 decreases, which reduces the resistance of the parallel combination of thermistor 227 and resistor 226. As a resistance of the parallel combination of resistor 226 and thermistor 227 decreases, the reference voltage appearing at circuit node 225 also decreases. Since pin 1 of LED driver 230 is coupled to circuit node 225, a decrease in the reference voltage appearing at circuit node 225 results in a corresponding decrease in the voltage appearing at pin 1 of LED driver 230, which in turn reduces the duty cycle of the signal at pin 7 of LED driver 230. As will be explained in greater detail below when the output stage 231 is described, reducing a duty cycle of the signal generated by LED 230 at pin 7 results in a dimming of a light engine 20 that is connected to the LED+, LED− output of dimmable power supply circuit 200. Thus, the presence of thermistor 227 provides a temperature protection function to dimmable power supply circuit 200.

At this point, output stage 231 of dimmable power supply circuit 200 is described in further detail. As indicated above, output stage 231 includes an NMOS power switching transistor 234 having a gate that is driven by pin 7 of LED driver 230. In some embodiments, transistor 234 is a power MOSFET, Part No. MPF10N65, manufactured by Miracle Technology Corporation.

Output stage 231 further includes diode 240 having an anode that is coupled to a drain of transistor 234, and a cathode that is coupled to circuit node 215. Output stage 231 further includes an inductor 232 that is coupled between a drain of transistor 234 and the LED− output of dimmable power supply circuit 200. Output stage 231 further includes a capacitor 242 and resistor 244 that are connected in parallel between circuit node 215 and the LED− output of dimmable power supply circuit 200. Circuit node 215 is coupled to the LED+ output of dimmable power supply circuit 200. The LED+ and LED− outputs of dimmable power supply circuit 200 is electrically connected to an LED light engine, such as LED light engine 20 of FIG. 1.

Output stage 231 additionally includes voltage regulator IC 246. In some embodiments, voltage regulator IC 246 is a 3-terminal, 1 A positive voltage regulator, Part No. LM7809, manufactured by Unisonic Technologies Co., Ltd. One input of voltage regulator IC 246 is coupled to the LED+ output (circuit node 215) of dimmable power supply circuit 200, another input of voltage regulator IC 246 is coupled to the LED− output of dimmable power supply circuit 200, and an output of voltage regulator IC 246 is coupled to the FAN+ output of dimmable power supply circuit 200. Note that the LED− output and the FAN− output of dimmable power supply circuit 200 are coupled together.

Functionally, voltage regulator IC 246 maintains the FAN+ output such that the difference between the FAN+ and FAN− outputs is substantially constant regardless of variations between the LED+ and LED− outputs. The FAN+ and FAN− outputs of dimmable power supply circuit 200 is coupled to fan 34. Thus, dimmable power supply circuit 200 is configured to provide a constant voltage to fan 34, and a constant flow of air is maintained regardless of a dimming level of the power supply circuit 200.

Now that the components and connections included in an example dimmable power supply circuit 200 have been described, a discussion of the overall functionality of dimmable power supply circuit 200 is presented. As indicated above, conversion stage 201 converts an AC input appearing across the ACL and ACN inputs into a DC output at circuit node 215. Circuit node 215 is coupled to the LED+ output of power supply circuit 200. The AC signal appearing at the ACL and ACN inputs of dimmable power supply circuit 200 is reduced or increased using an external AC dimmer circuit. As an AC voltage at the ACL and ACN inputs increases or decreases, a voltage appearing at circuit node 215 smoothly increases or decreases along with it.

In control stage 213, a voltage that appears across zener diode 216 and a voltage that appears across a base-emitter junction of transistor 220 remains substantially constant as voltage at circuit node 215 varies in accordance with an external AC dimming circuit. Thus, a voltage appearing at circuit node 221 also remains substantially constant in the presence of external dimming. As was indicated above, pin 8 of LED driver 230 is coupled to circuit node 221, and LED driver 230 uses the voltage at circuit node 221 to generate an internal operating voltage.

LED driver 230 generates a switching signal at pin 7 having a maximum duty cycle that is controlled by the reference voltage appearing at pin 1 of LED driver 230. Pin 1 of LED driver 230 is coupled to circuit node 225. As was explained above, resistor 224, resistor 226, and thermistor 227 function as a temperature-dependent voltage divider that sets the voltage appearing at circuit node 225 as some fraction of the voltage appearing at circuit node 215. The presence of external dimming increases or decreases a voltage that appears at circuit node 215.

Thus, there exists at least two ways in which the reference voltage at circuit node 225 can be altered and therefore at least two ways to control a maximum duty cycle of the switching signal that LED driver 230 generates at pin 7. First, external dimming can increase or decrease the voltage at circuit node 215, which will result in an increase or decrease in the voltage at circuit node 225 according to the values of resistor 224, resistor 226, and thermistor 227. Second, a resistance of thermistor 227 is temperature-dependent, so temperature changes can alter a voltage at circuit node 225 even in the absence of external dimming.

Pin 7 of LED driver 230 is coupled to a control terminal, or gate, of transistor 234. Thus, pin 7 of LED driver 230 determines whether transistor 234 is in a conductive, or "on" state, or whether transistor 234 is in a non-conductive, or "off" state.

When the switching signal from pin 7 of LED driver 230 places transistor 234 in an "on" state, a conduction path is established in transistor 234, and current flows from circuit node 215, through capacitor 242, through inductor 232, through the conductive terminals (drain and source) of transistor 234, and through the parallel combination of resistors 236 and 238. The voltage across LED+ and LED− is equal to the voltage across capacitor 242.

When transistor 234 is in an "on" state, diode 240 is reverse-biased, and no current flows through diode 240. Inductor 232 of output stage 231 is a passive electrical component that stores energy in a magnetic field that is created by the current flowing in it. Electric current passing through inductor 232 creates a magnetic flux proportional to the current, and a change in the current creates a corresponding change in magnetic flux which, in turn, generates an electromotive force (EMF) that opposes the change in current. The longer that current flows through inductor 232, the more energy that is stored, up to a limit that is determined by the particular inductance value (in units of henries, or H) of inductor 232.

The duty cycle of the switching signal generated by LED driver 230 at pin 7 directly determines an amount of energy that is stored in inductor 232 by controlling an amount of time that transistor 234 is in a conductive state over one switching cycle of the signal from pin 7. One switching cycle is defined as one complete waveform of the signal, where the signal is assumed to be periodic. The duty cycle indicates an amount of time that the switching signal from pin 7 of LED driver 230 is at a logic one value during one switching cycle of the signal. For example, a duty cycle of 50% would indicate that the switching signal at pin 7 is at a "logic one" value, and transistor 234 is in an "on," or conductive state, for 50% of one switching cycle. Conversely, a 50% duty cycle also indicates that transistor 234 is in an "off," or non-conductive state, for 50% of one switching cycle.

Increasing the duty cycle of the switching signal from pin 7 of LED driver 230 increases the percentage of time that transistor 234 is "on" in one switching cycle, while decreasing the duty cycle of the switching signal from pin 7 of LED driver 230 decreases the percentage of time that transistor 234 is "on" in one switching cycle.

When the switching signal from pin 7 of LED driver 230 is in an "off" state, the conductive path through the conductive terminals of transistor 234 is closed down. At this time, the inductor 232 discharges its stored energy as current that flows in a loop through inductor 232, diode 240, and capacitor 242. The voltage across LED+ and LED− is equal to the voltage across capacitor 242. When an AC input across terminals ACL and ACN is removed (power to dimmable power supply circuit 200 is turned off), resistor 244 functions to quickly discharge capacitor 244 and cause LED light engine 20 to switch off quickly.

If the AC input appearing across ACL and ACN is reduced, for example when dimmable power supply circuit 200 is operated in conjunction with an external AC dimmer circuit that functions to reduce the AC input at ACL and ACN, the voltage at node 215 is also reduced. Decreasing the voltage at node 215 results in a decrease in the voltage at node 225. The voltage at node 225 is tied to pin 1 of LED driver 230 and sets the maximum duty cycle of the switching signal that is generated by LED driver 230 at pin 7. Thus, decreasing the voltage at node 225 results in a reduced duty cycle from the switching signal that is output from pin 7 of LED driver 230.

As was explained above, a reduction in the duty cycle from the switching signal from pin 7 of LED driver 230 means that the percentage of time that transistor 234 is "on" relative to the time that is "off," is reduced, and thus less energy is stored in inductor 232 during the "on" periods. Less energy stored in inductor 232 during the "on" periods means a lower voltage delivered to LED light engine 20. The lower voltage delivered to LED light engine 20 results in less light being generated by LED light engine 20.

If the AC input voltage across ACL and ACN is again raised, the voltage at circuit node 215 rises as well, which brings up the reference voltage at circuit node 225. The rise in the reference voltage at node 225 causes LED driver 230 to increase the duty cycle of the switching signal that is output from pin 7. The increased duty cycle results in an increase in the percentage of time that transistor 234 is in the "on" state relative to the time that it is in the "off" state over one switching cycle, and thus more energy is stored in inductor 232 during the "on" states. More energy stored in inductor 232 during the "on" periods means a higher voltage is delivered to light engine 20. The higher voltage delivered to LED light engine 20 results in an increase of the light that is generated by LED light engine 20.

Based on the explanation that was presented in the paragraphs above, dimmable power supply circuit 200 is capable of reducing and increasing the brightness of LED light engine 20 while delivering constant cooling airflow from fan 34 that is attached to the FAN+ and FAN− outputs.

There are numerous advantages associated with dimmable power supply circuit 200. For example, the RC filter in conversion stage 201, including resistor 206 and capacitors 204, 208, provides a smooth dimming function. That is, the voltage node 215 is smoothly reduced in response to a reduction in the AC input at ACL and ACN. Another advantage is that power supply circuit 200 is non-insulated. That is, a lack of insulation between the AC input (ACL and ACN) and the low voltage DC output (LED+ and LED−; FAN+ and FAN−) leads to greater AC to DC conversion efficiency. For example, dimmable power supply circuit 200 has an efficiency of greater than 90%.

Dimmable power supply circuit 200 also does not utilize a transformer—only a single inductor coil 232 is present—resulting in reduced space requirements. Using only inductor 232 to drive LED light engine 20 also results in an excellent power factor—about 0.95 for dimmable power supply circuit 200.

Another advantage to dimmable power supply circuit 200 is the combination of the DC outputs FAN+, FAN− for driving fan 34 and voltage regulator IC 246 that maintains the difference between FAN+ and FAN− such that a constant airflow is delivered from fan 34 in FIGS. 1 and 3 regardless of the dimming level. As explained above, power supply circuit 200 also includes thermistor 227, which provides over-temperature protection.

Figure 7:
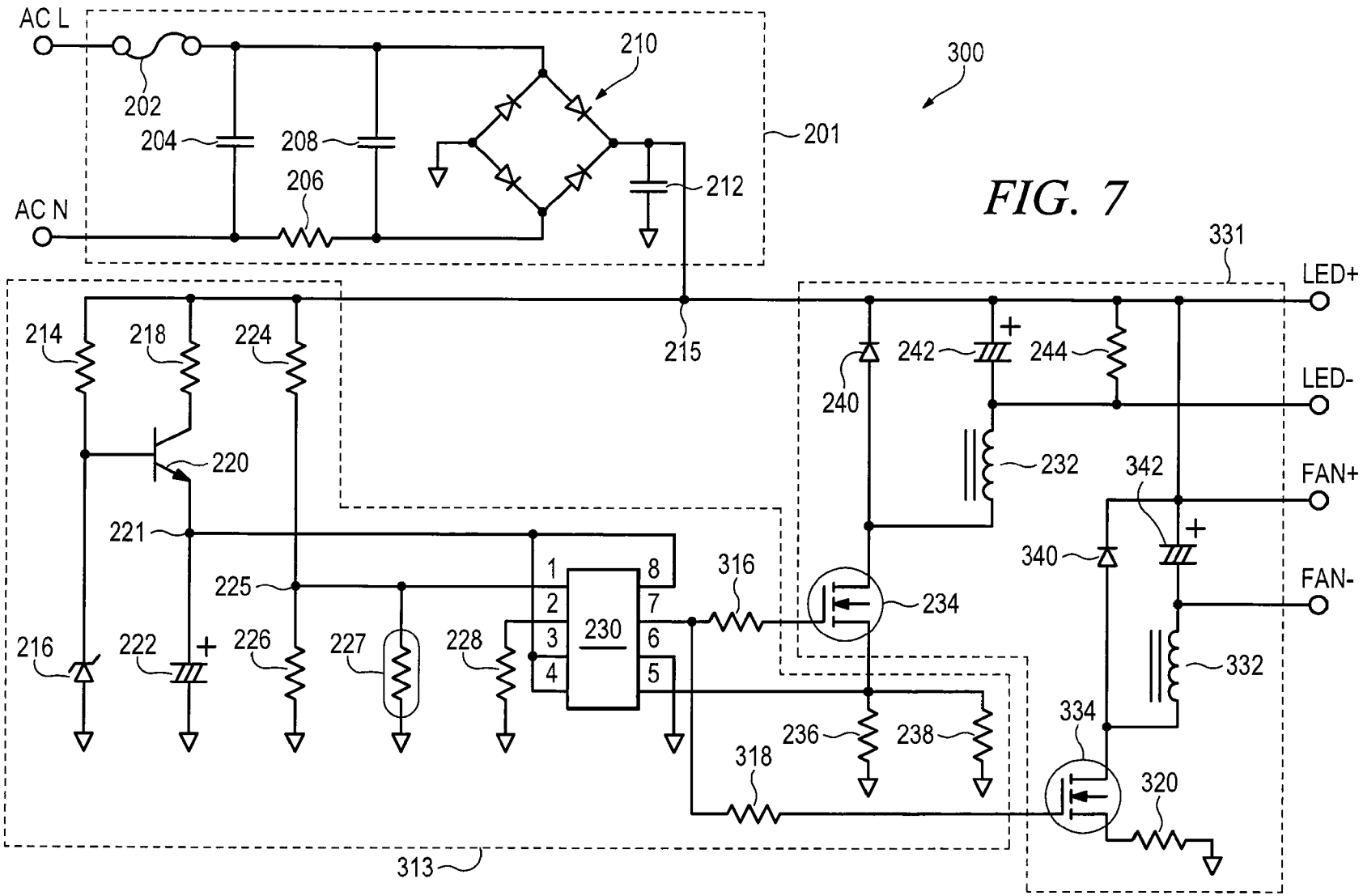
FIG. 7 is a circuit diagram illustrating another dimmable power supply circuit suitable for the power assembly of the LED lamp of FIG. 1.

FIG. 7 is a circuit diagram illustrating another dimmable power supply circuit 300 suitable for implementing in power assembly 50 of LED lamp 100 of FIG. 1. The numerous circuit elements constituting dimmable power supply circuit 300 are disposed on circuit board 60 in FIG. 3 of power assembly 50, and take the form of discrete circuit elements or IC packages. The conductive elements such as bumps, traces, or wiring that are used to electrically connect the various circuit elements are not shown on circuit board 60 of FIG. 3.

Turning now to FIG. 7, dimmable power supply circuit 300 can be arbitrarily subdivided, for convenience and ease of explanation, into several different stages. These stages may be referred to as conversion stage 201, control stage 313, and output stage 331.

A main component of conversion stage 201 is bridge rectifier 210. Bridge rectifier 210 includes four diodes. A cathode of a first diode is coupled to an anode of a second diode, a cathode of the second diode is coupled to an anode of a third diode, a cathode of the third diode is coupled to an anode of a fourth diode, and a cathode of the fourth diode is coupled to an anode of the first diode. In some embodiments, bridge rectifier 210 is a four-pin IC package such as DB107, a 1.0 A glass passivated bridge rectifier manufactured by Diodes Incorporated.

Bridge rectifier 210 thus forms four circuit nodes, with one circuit node disposed between each of the diodes. A first node of the bridge rectifier 210 is coupled to ground, while a second node of the bridge rectifier 210 is coupled to circuit node 215, which forms the LED+ output of output stage 231. Output stage 231 will be described in greater detail below.

Conversion stage 201 further includes resistor 206, which is coupled between a third node of bridge rectifier 210 and the ACN input. Conversion stage 213 further includes fuse 202, which is coupled between a fourth node of bridge rectifier 210 and the ACL input.

Conversion stage 201 also includes capacitors 204, 208, and 212. Capacitor 212 is coupled between the second node of bridge rectifier 210 and ground. Capacitor 204 is coupled between the fourth node of bridge rectifier 210 and the ACN input. Capacitor 208 is coupled between the third node of bridge rectifier 210 and the ACL input.

Functionally speaking, conversion stage 201 converts an input of about 120 VAC to about 277 VAC appearing across the inputs ACL and ACN into a DC output at circuit node 215, which is coupled to the LED+ output of dimmable power supply circuit 300. In conversion stage 201, capacitors 204, 208 and resistor 206 form an RC filter between the ACL and ACN inputs and the bridge rectifier 210. Capacitor 212, which is coupled between circuit node 215 and ground, performs additional filtering. The combination of the RC filter comprising capacitors 204, 208 and resistor 206 along with capacitor 212 coupled between circuit node 215 and ground provides a smooth dimming function for conversion stage 201. That is, a voltage at circuit node 215 is smoothly increased or decreased in response to a corresponding increase or decrease in the AC input across ACL and ACN.

An AC input across input terminals ACL and ACN can be controlled using an external dimming circuit that utilizes forward phase, reverse phase or sine wave control to reduce or increase a magnitude of the AC input. The forward phase, reverse phase, or sine wave control dimming techniques are typically implemented with an SCR, Triac, PWM, or IGBT, as described above.

Next, control stage 313 of dimmable power supply circuit 300 is described. Control stage 313 includes an LED driver 230 in the form of an 8-pin IC package. In the illustrated embodiments, LED driver 230 is a high-power LED driver, part number MLX10803, which is manufactured by Melexis.

Control stage 313 includes resistor 214 and zener diode 216, which are coupled between circuit node 215 and ground. Control stage 213 additionally includes resistor 218, transistor 220, and capacitor 222. One end of resistor 218 is coupled to circuit node 215, while another end of resistor 218 is coupled to a collector of transistor 220. The base of transistor 220 is coupled to the cathode of zener diode 216, while capacitor 222 is coupled between an emitter of transistor 220 and ground.

Control stage 313 additionally includes resistor 224 and resistor 226, which are coupled between circuit node 215 and ground. Circuit node 225 is disposed between resistors 224 and 225. Control stage 213 additionally includes a NTC resistor, or thermistor 227, coupled between circuit node 225 and ground. As temperature increases, a resistance of thermistor 227 decreases.

Control stage 313 additionally includes resistors 236 and 238, which are coupled in parallel between pin 5 of LED driver 230 and ground. Control stage 313 further includes resistor 228, which is coupled between pin 2 of LED driver 230 and ground. Control stage 313 additionally includes resistors 316 and 318. Resistor 316 is coupled between pin 7 of LED driver 230 and a gate of transistor 234 in output stage 331. Resistor 318 is coupled between pin 7 of LED driver 230 and a gate of transistor 334 in output stage 331.

Pin 1 of LED driver 230 is coupled to circuit node 225. As mentioned above, pin 2 of LED driver 230 is coupled to resistor 228. Pins 3, 4, and 8 of LED driver 230 are all coupled to circuit node 221 at the emitter of transistor 220. Pin 5 of LED driver 230 is coupled to resistors 236 and 238 and to a source of power switching transistor 234, which is part of output stage 331 and will be described in further detail below. Pin 6 of LED driver 230 is coupled to ground, and pin 7 of LED driver 230 is coupled to a gate of transistor 234.

When dimmable power supply circuit 300 is operational, a voltage across zener diode 216 remains relatively constant, as does a voltage across a base-emitter junction of transistor 220. The voltage at circuit node 221 is equal to the voltage across zener diode 216 less the base-emitter voltage of transistor 220.

As indicated above, pins 3, 4, and 8 of LED driver 230 are coupled to each other and also to the emitter of transistor 220 at node 221. LED driver 230 uses the voltage at node 221 as a Vs to derive an internal operating voltage. LED driver 230 is capable of using the voltages on pins 3 and 4 to perform temperature regulation functions.

As will be discussed in further detail when output stage 331 is described, when transistor 234 is "on," current flows through transistor 234 and through the parallel combination of resistors 236 and 238. LED driver 230 uses pin 5, which is coupled to resistors 236 and 248 and to the source of transistor 234, to detect an over-current situation and is capable of placing transistor 234 is an "off" state when an over-current situation is detected.

Pin 2 of LED driver 230 is coupled to resistor 228. By choosing an appropriate resistance for resistor 228, resistor 228 is used to set an oscillation frequency for an internal oscillator within LED driver 230. Pin 1 of LED driver 230 is coupled to circuit node 225. A voltage at circuit node 225 functions as a reference voltage that sets a maximum duty cycle for the switching signal that is output from LED driver 230 at pin 7. The switching signal that is output from pin 7 of LED driver 230 is coupled to drive the gate of transistor 234.

When dimmable power supply circuit 300 is operational, resistor 224, resistor 226, and thermistor 227 function as a temperature-dependent voltage divider which produces a voltage at circuit node 225 that is a fraction of the voltage that appears at circuit node 215. The specific fraction is determined by a ratio of a resistance of the parallel combination of resistor 226 and thermistor 227 to a sum of the resistances of resistor 224 and the parallel combination of resistor 226 and thermistor 227.

Thermistor 227 is a negative temperature coefficient resistor. Thus, as temperature increases, a resistance of thermistor 227 decreases, which results in a reduction in a resistance of the parallel combination of thermistor 227 and resistor 226. As a resistance of the parallel combination of resistor 226 and thermistor 227 decreases, the reference voltage appearing at circuit node 225 also decreases. Since pin 1 of LED driver 230 is coupled to circuit node 225, a decrease in the reference voltage appearing at circuit node 225 results in a corresponding decrease in the voltage appearing at pin 1 of LED driver 230, which in turn reduces the duty cycle of the switching signal at pin 7 of LED driver 230. As will be explained in greater detail below when the output stage 331 is described, reducing a duty cycle of the switching signal generated by LED 230 at pin 7 results in a dimming of light engine 20 that is connected to the LED+, LED− output of dimmable power supply circuit 300. Thus, the presence of thermistor 227 provides a temperature protection function to dimmable power supply circuit 300.

At this point, output stage 331 of dimmable power supply circuit 200 is described in further detail. As indicated above, output stage 331 includes an NMOS power switching transistor 234 having a gate that is driven by pin 7 of LED driver 230. In some embodiments, transistor 234 is a power MOSFET, Part No. MPF10N65, manufactured by Miracle Technology Corporation.

Output stage 331 further includes diode 240 having an anode that is coupled to a drain of transistor 234, and a cathode that is coupled to circuit node 215. Output stage 331 further includes an inductor 232 that is coupled between a drain of transistor 234 and the LED− output of dimmable power supply circuit 200. Output stage 331 further includes capacitor 242 and resistor 244 that are connected in parallel between circuit node 215 and the LED− output of dimmable power supply circuit 300. Circuit node 215 is coupled to the LED+ output of dimmable power supply circuit 300. The LED+ and LED− outputs of dimmable power supply circuit 300 can be electrically connected to an LED light engine, such as LED light engine 20 of FIG. 1.

Output stage 331 further includes diode 340 having an anode that is coupled to a drain of transistor 334, and a cathode that is coupled to circuit node 215. Output stage 331 further includes an inductor 332 that is coupled between a drain of transistor 334 and the FAN− output of dimmable power supply circuit 300. Output stage 331 further includes capacitor 342 that is connected between circuit node 215 and the FAN− output of dimmable power supply circuit 300. Circuit node 215 is coupled to the FAN+ output of dimmable power supply circuit 300. In this embodiment, the LED+ and FAN+ outputs are both coupled to circuit node 215. The FAN+ and FAN− outputs of dimmable power supply circuit 300 are electrically connected to fan 34.

Now that the components and connections included in an example dimmable power supply circuit 300 have been described, a discussion of the overall functionality of dimmable power supply circuit 300 is presented. As indicated above, conversion stage 201 converts an AC input appearing across the ACL and ACN inputs into a DC output at circuit node 215. Circuit node 215 is coupled to the LED+ output of power supply circuit 300. The AC signal appearing at the ACL and ACN inputs of dimmable power supply circuit 300 can be reduced or increased using an external AC dimmer circuit. As an AC voltage at the ACL and ACN inputs increases or decreases, a voltage appearing at circuit node 215 smoothly increases or decreases along with it.

In control stage 313, a voltage that appears across zener diode 216 and a voltage that appears across a base-emitter junction of transistor 220 remains substantially constant as the voltage at circuit node 215 varies in accordance with the external AC dimming circuit. Thus, a voltage appearing at circuit node 221 also remains substantially constant in the presence of external dimming. As was indicated above, pin 8 of LED driver 230 is coupled to circuit node 221, and LED driver 230 uses the voltage at circuit node 221 to generate an internal operating voltage.

LED driver 230 generates a switching signal at pin 7 having a maximum duty cycle that is controlled by the reference voltage appearing at pin 1 of LED driver 230. Pin 1 of LED driver 230 is coupled to circuit node 225. As was explained above, resistor 224, resistor 226, and thermistor 227 function as a temperature-dependent voltage divider that sets the voltage appearing at circuit node 225 as some fraction of the voltage appearing at circuit node 215. The presence of external dimming increases or decreases a voltage that appears at circuit node 215.

Thus, there exists at least two ways in which the reference voltage at circuit node 225 can be altered and therefore at least two ways to control a maximum duty cycle of the switching signal that LED driver 230 generates at pin 7. First, external dimming increases or decreases the voltage at circuit node 215, which will result in an increase or decrease in the voltage at circuit node 225 according to the values of resistor 224, resistor 226, and thermistor 227. Second, a resistance of thermistor 227 is temperature-dependent, so temperature changes can alter a voltage at circuit node 225 even in the absence of external dimming.

Pin 7 of LED driver 230 is coupled to a control terminal, or gate, of transistor 234 through resistor 318. Pin 7 of LED driver 230 is also coupled to a control terminal, or gate, of transistor 334 through resistor 318. Thus, pin 7 of LED driver 230 determines whether transistors 234 and 334 are in a conductive, or "on" state, or whether transistors 234 and 334 are in a non-conductive, or "off" state.

When the switching signal from pin 7 of LED driver 230 places transistor 234 in an "on" state, a conduction path is established in transistor 234, and current flows from circuit node 215, through capacitor 242, through inductor 232, through the conductive drain and source terminals of transistor 234, and through the parallel combination of resistors 236 and 238. The voltage across LED+ and LED− is equal to the voltage across capacitor 242. Similarly, when the switching signal from pin 7 of LED driver 230 places transistor 334 in an "on" state, a conduction path is established in transistor 334, and current flows from circuit node 215, through capacitor 342, through inductor 332, through the conductive drain and source terminals of transistor 334, and through resistor 320. The voltage across FAN+ and FAN− is equal to the voltage across capacitor 342. When transistors 234 and 334 are in an "on" state, diodes 240 and 340 are reverse-biased, and no current flows through diodes 240 and 340.

Inductors 232 and 332 of output stage 331 are passive electrical components that store energy magnetic fields that are created by current flowing through inductors 232 and 332. Electric current passing through inductors 232 and 332 creates a magnetic flux proportional to the current, and a change in the current creates a corresponding change in magnetic flux which, in turn, generates an EMF that opposes the change in current. The longer that current flows through inductors 232 and 332 the more energy that is stored, up to a limit that is determined by the particular individual inductance values H of inductors 232 and 332.

The duty cycle of the switching signal generated by LED driver 230 at pin 7 directly determines an amount of energy that is stored in inductors 232 and 332 by controlling an amount of time that transistors 234 and 334 are in a conductive state over one switching cycle of the signal from pin 7. One switching cycle is defined as one complete waveform of the signal, where the signal is assumed to be periodic. The duty cycle indicates an amount of time that the switching signal from pin 7 of LED driver 230 is at a logic one value during one switching cycle of the signal. For example, a duty cycle of 50% would indicate that the switching signal at pin 7 is at a "logic one" value, and transistor 234 is in an "on," or conductive state, for 50% of one switching cycle. Conversely, a 50% duty cycle also indicates that 234 is in an "off," or non-conductive state, for 50% of one switching cycle.

Increasing the duty cycle of the switching signal from pin 7 of LED driver 230 increases the percentage of time that transistors 234 and 334 are "on" in one switching cycle, while decreasing the duty cycle of the switching signal from pin 7 of LED driver 230 decreases the percentage of time that transistors 234 and 334 are "on" in one switching cycle.

When the switching signal from pin 7 of LED driver 230 is in an "off" state, the conductive paths through the conductive terminals of transistors 234 and 334 are closed down. At this time, inductors 232 and 332 discharge their stored energy as current. Current flows in a loop through inductor 232, diode 240, and capacitor 242. Similarly, current flows in a loop through inductor 332, diode 340, and capacitor 342. The voltage across LED+ and LED− is equal to the voltage across capacitor 242. The voltage across FAN+ and FAN− is equal to the voltage across capacitor 342. When an AC input across terminals ACL and ACN is removed (power to dimmable power supply circuit 300 is turned off), resistor 244 functions to quickly discharge capacitor 244 and cause LED light engine 20 to switch off quickly.

If the AC input appearing across ACL and ACN is reduced, for example when dimmable power supply circuit 300 is operated in conjunction with a dimmer circuit that functions to reduce the AC input at ACL and ACN, a voltage at node 215 is also reduced. Decreasing the voltage at node 215 results in a decrease in the voltage at node 225. The voltage at node 225 is tied to pin 1 of LED driver 230 and sets the maximum duty cycle of the switching signal that is generated by LED driver 230 at pin 7. Thus, decreasing the voltage at node 225 results in a reduced duty cycle from the switching signal that is output from pin 7 of LED driver 230.

As was explained above, a reduction in the duty cycle from the switching signal from pin 7 of LED driver 230 means that the percentage of time that transistors 234 and 334 are "on" relative to the time that they are "off" is reduced, and thus less energy is stored in inductors 232 and 332 during the "on" periods. Less energy stored in inductors 232 and 332 during the "on" periods means a lower voltage is developed across resistors 244 and 344 and delivered to LED light engine 20 and to fan 34. The lower voltage delivered to LED light engine 20 results in less light being generated by LED light engine 20, and less energy delivered to fan 34 results in less forced air cooling.

If the AC input voltage across ACL and ACN is again raised, the voltage at circuit node 215 rises as well, which brings up the reference voltage at circuit node 225. The rise in the reference voltage at node 225 causes LED driver 230 to increase the duty cycle of the switching signal that is output from pin 7. The increased duty cycle results in an increase in the percentage of time that transistors 234 and 334 are in the "on" state relative to the time that they are in the "off" state over one switching cycle, and thus more energy is stored in inductors 232 and 332 during the "on" states. More energy stored in inductors 232 and 332 during the "on" periods means a higher voltage developed across resistors 244 and 344 and delivered to light engine 20. The higher voltage delivered to LED light engine 20 results in an increase of the light that is generated by LED light engine 20, and higher voltage delivered to fan 34 results in more forced air cooling.

Based on the explanation that was presented in the paragraphs above, dimmable power supply circuit 300 is capable of reducing and increasing the brightness of LED light engine 20 while delivering variable cooling airflow from fan 34 that is attached to the FAN+ and FAN− outputs. As explained above, the level of cooling airflow tracks the dimming level of the LED light engine 20.

There are numerous advantages associated with dimmable power supply circuit 300. For example, the RC filter in conversion stage 201, including resistor 206 and capacitors 204, 208, provides a smooth dimming function. That is, the voltage node 215 is smoothly reduced in response to a reduction in the AC input at ACL and ACN. Another advantage is that power supply circuit 300 is non-insulated. That is, a lack of insulation between the AC input ACL and ACN and the low voltage DC outputs LED+ and LED−, FAN+ and FAN− leads to greater AC to DC conversion efficiency. For example, dimmable power supply circuit 300 has an efficiency of greater than 90%.

Dimmable power supply circuit 300 also does not utilize transformers—only two separate inductor coils 232 and 332 are present—resulting in reduced space requirements. Using inductor 232 to drive LED light engine 20 and inductor 332 to drive fan 34 also results in an excellent power factor—about 0.95 for dimmable power supply circuit 300.

Another advantage to dimmable power supply circuit 300 is the combination of the DC outputs FAN+, FAN− for driving fan 34 such that the level of cooling airflow delivered rises and falls with the increase and decrease in dimming level. Thus, less cooling airflow is delivered when light engine 20 is generating less heat. As explained above, power supply circuit 300 also includes thermistor 227, which provides overtemperature protection.

Figure 8:
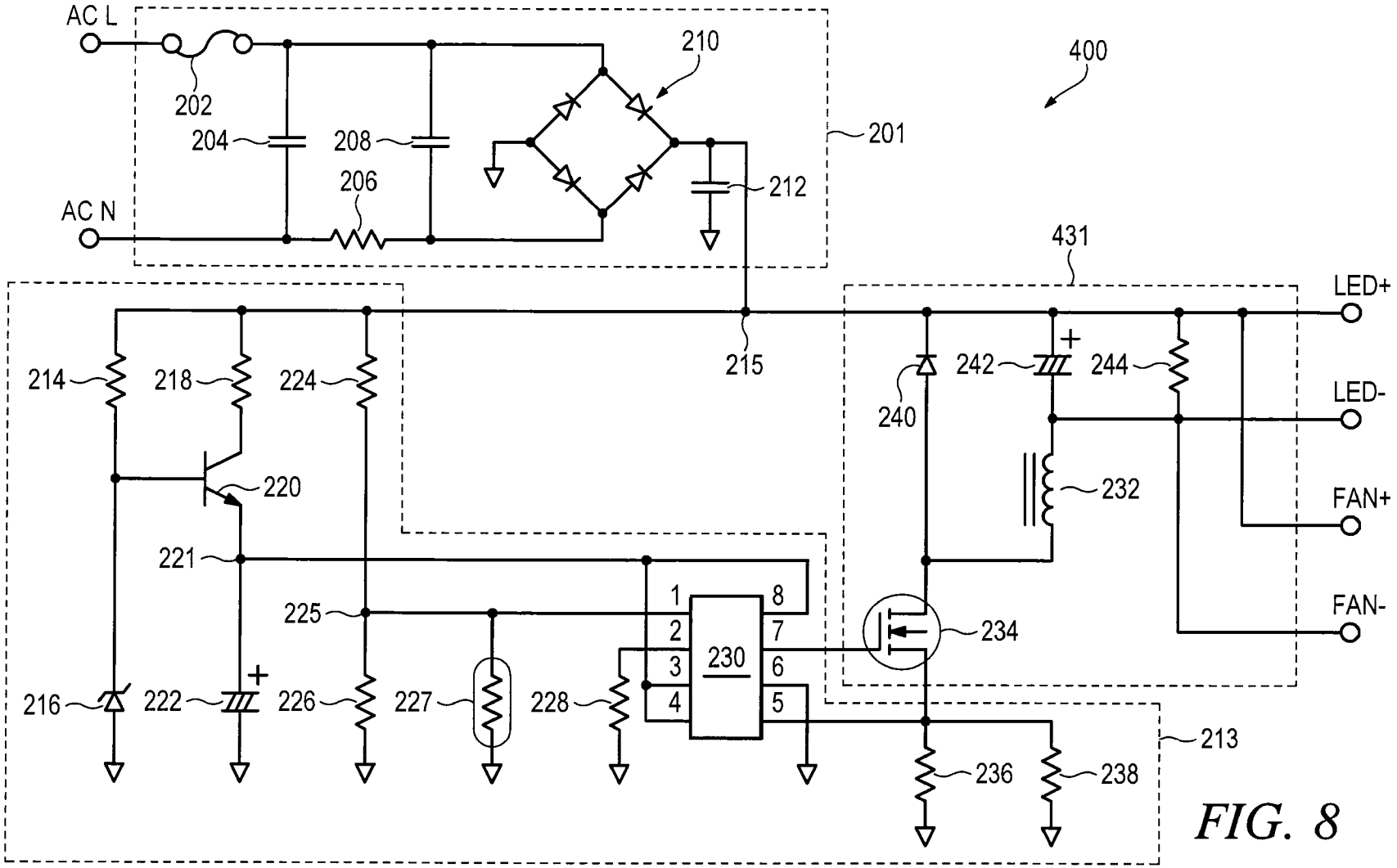
FIG. 8 is a circuit diagram illustrating still another dimmable power supply circuit suitable for the power assembly of the LED lamp of FIG. 1.

FIG. 8 is a circuit diagram illustrating dimmable power supply circuit 400 suitable for implementing in power assembly 50 of LED lamp 100 of FIG. 1. The numerous circuit elements constituting dimmable power supply circuit 400 are disposed on circuit board 60 in FIG. 3 of power assembly 50, and take the form of discrete circuit elements or IC packages. The conductive elements such as bumps, traces, or wiring that are used to electrically connect the various circuit elements are not shown on circuit board 60 of FIG. 3.

Turning now to FIG. 8, dimmable power supply circuit 400 can be arbitrarily subdivided, for convenience and ease of explanation, into several different stages. These stages are referred to as conversion stage 201, control stage 213, and output stage 431.

A main component of conversion stage 201 is bridge rectifier 210. Bridge rectifier 210 includes four diodes. A cathode of a first diode is coupled to an anode of a second diode, a cathode of the second diode is coupled to an anode of a third diode, a cathode of the third diode is coupled to an anode of a fourth diode, and a cathode of the fourth diode is coupled to an anode of the first diode. In some embodiments, bridge rectifier 210 is a four-pin IC package such as DB107, a 1.0 A glass passivated bridge rectifier manufactured by Diodes Incorporated.

Bridge rectifier 210 thus forms four circuit nodes, with one circuit node disposed between each of the diodes. A first node of the bridge rectifier 210 is coupled to ground, while a second node of the bridge rectifier 210 is coupled to circuit node 215, which forms the LED+ output and FAN+ output of output stage 431. Output stage 431 will be described in greater detail below.

Conversion stage 201 further includes resistor 206, which is coupled between a third node of bridge rectifier 210 and the ACN input. Conversion stage 213 further includes fuse 202, which is coupled between a fourth node of bridge rectifier 210 and the ACL input.

Conversion stage also includes capacitors 204, 208, and 212. Capacitor 212 is coupled between the second node of bridge rectifier 210 and ground. Capacitor 204 is coupled between the fourth node of bridge rectifier 210 and the ACN input. Capacitor 208 is coupled between the third node of bridge rectifier 210 and the ACL input.

Functionally speaking, conversion stage 201 converts an input of about 120 VAC to about 277 VAC appearing across the inputs ACL and ACN into a DC output at circuit node 215, which is coupled to the LED+ output and FAN+ output of dimmable power supply circuit 400. In conversion stage 201, capacitors 204, 208 and resistor 206 form an RC filter between the ACL and ACN inputs and the bridge rectifier 210. Capacitor 212, which is coupled between circuit node 215 and ground, performs additional filtering. The combination of the RC filter comprising capacitors 204, 208 and resistor 206 along with capacitor 212 coupled between circuit node 215 and ground provides a smooth dimming function for conversion stage 201. That is, a voltage at circuit node 215 can be smoothly increased or decreased in response to a corresponding increase or decrease in the AC input across ACL and ACN.

An AC input across input terminals ACL and ACN can be controlled using an external dimming circuit that utilizes forward phase, reverse phase or sine wave control to reduce or increase a magnitude of the AC input. Forward phase, reverse phase, or sine wave control dimming techniques are typically implemented with SCR, Triac, PWM, or IGBT, as described above.

Next, control stage 213 of dimmable power supply circuit 400 is described. Control stage 213 includes an LED driver 230 in the form of an 8-pin IC package. In the illustrated embodiments, LED driver 230 is a high-power LED driver, part number MLX10803, which is manufactured by Melexis.

Control stage 213 includes resistor 214 and zener diode 216, which are connected between circuit node 215 and ground. Control stage 213 additionally includes resistor 218, transistor 220, and capacitor 222. One end of resistor 218 is coupled to circuit node 215, while another end of resistor 218 is coupled to a collector of transistor 220. The base of transistor 220 is coupled to the cathode of zener diode 216, while capacitor 222 is coupled between an emitter of transistor 220 and ground.

Control stage 213 additionally includes resistor 224 and resistor 226, which are coupled between circuit node 215 and ground. Circuit node 225 is disposed between resistors 224 and 225. Control stage 213 additionally includes a NTC resistor, or thermistor 227, coupled between circuit node 225 and ground. As temperature increases, a resistance of thermistor 227 decreases.

Control stage 213 additionally includes resistors 236 and 238, which are coupled in parallel between pin 5 of LED driver 230 and ground. Control stage 213 further includes resistor 228, which is coupled between pin 2 of LED driver 230 and ground.

Pin 1 of LED driver 230 is coupled to circuit node 225. As mentioned above, pin 2 of LED driver 230 is coupled to resistor 228. Pins 3, 4, and 8 of LED driver 230 are all coupled to circuit node 221 at the emitter of transistor 220. Pin 5 of LED driver 230 is coupled to resistors 236 and 238 and to a source of transistor 234, which is part of output stage 431 and will be described in further detail below. Pin 6 of LED driver 230 is coupled to ground, and pin 7 of LED driver 230 is coupled to a gate of transistor 234.

When dimmable power supply circuit 400 is operational, a voltage across zener diode 216 remains relatively constant, as does a voltage across a base-emitter junction of transistor 220. The voltage at circuit node 221 is equal to the voltage across zener diode 216 less the base-emitter voltage of transistor 220.

As indicated above, pins 3, 4, and 8 of LED driver 230 are coupled to each other and also to the emitter of transistor 220 at node 221. LED driver 230 uses the voltage at node 221 as a Vs to derive an internal operating voltage. LED driver 230 is capable of using the voltages on pins 3 and 4 to perform temperature regulation functions.

As will be discussed in further detail when output stage 431 is described, when transistor 234 is "on," current flows through transistor 234 and through the parallel-connected combination of resistors 236 and 238. LED driver 230 uses pin 5, which is coupled to resistors 236 and 248 and to the source of transistor 234, to detect an over-current situation and is capable of placing transistor 234 in an "off" state when an over-current situation is detected.

Pin 2 of LED driver 230 is coupled to resistor 228. By choosing an appropriate resistance for resistor 228, resistor 228 is used to set an oscillation frequency for an internal oscillator within LED driver 230. Pin 1 of LED driver 230 is coupled to circuit node 225. A voltage at circuit node 225 functions as a reference voltage that sets a maximum duty cycle for a switching signal that is output from LED driver 230 at pin 7. The switching signal that is output from pin 7 of LED driver 230 is coupled to drive the gate of transistor 234.

When dimmable power supply circuit 400 is operational, resistor 224, resistor 226, and thermistor 227 functions as a temperature-dependent voltage divider which produces a voltage at circuit node 225 that is a fraction of the voltage that appears at circuit node 215. The specific fraction is determined by a ratio of a resistance of the parallel combination of resistor 226 and thermistor 227 to a sum of the resistances of resistor 224 and the parallel combination of resistor 226 and thermistor 227.

Thermistor 227 is a negative temperature coefficient resistor. Thus, as temperature increases, a resistance of thermistor 227 decreases, which reduces the resistance of the parallel combination of thermistor 227 and resistor 226. As a resistance of the parallel combination of resistor 226 and thermistor 227 decreases, the reference voltage appearing at circuit node 225 also decreases. Since pin 1 of LED driver 230 is coupled to circuit node 225, a decrease in the reference voltage appearing at circuit node 225 results in a corresponding decrease in the voltage appearing at pin 1 of LED driver 230, which in turn reduces the duty cycle of the switching signal at pin 7 of LED driver 230. As will be explained in greater detail below when the output stage 231 is described, reducing a duty cycle of the switching signal generated by LED 230 at pin 7 results in a dimming of light engine 20 that is connected to the LED+, LED− output of dimmable power supply circuit 200. Thus, the presence of thermistor 227 provides a temperature protection function to dimmable power supply circuit 400.

At this point, output stage 431 of dimmable power supply circuit 400 is described in further detail. As indicated above, output stage 431 includes an NMOS power switching transistor 234 having a gate that is driven by pin 7 of LED driver 230. In some embodiments, transistor 234 is a power MOSFET, Part No. MPF10N65, manufactured by Miracle Technology Corporation.

Output stage 431 further includes diode 240 having an anode that is coupled to a drain of transistor 234, and a cathode that is coupled to circuit node 215. Output stage 431 further includes an inductor 232 that is coupled between a drain of transistor 234 and the LED− and FAN− outputs of dimmable power supply circuit 400. Output stage 431 further includes a capacitor 242 and resistor 244 that are connected in parallel between circuit node 215 and the LED− and FAN− outputs of dimmable power supply circuit 400. Circuit node 215 is coupled to the LED+ and FAN+ outputs of dimmable power supply circuit 400. The LED+ and LED− outputs of dimmable power supply circuit 400 are electrically connected to an LED light engine, such as LED light engine 20 of FIG. 1. The FAN+ and FAN− outputs of dimmable power supply circuit 400 are electrically connected to fan 34.

Functionally, because the LED+ output and LED− output of dimmable power supply circuit 400 are coupled to the FAN+ output and FAN− output, respectively, the voltage supplied to an LED light engine coupled to the LED+ and LED− outputs is the same as the voltage supplied to fan 34 which is coupled to the FAN+ and FAN− outputs. Therefore, the amount of forced convection airflow delivered to an LED lamp incorporating dimmable power supply circuit 400 will follow the amount of light output from the LED light engine.

Now that the components and connections included in an example dimmable power supply circuit 400 have been described, a discussion of the overall functionality of dimmable power supply circuit 400 is presented. As indicated above, conversion stage 201 converts an AC input appearing across the ACL and ACN terminals into a DC output at circuit node 215. Circuit node 215 is coupled to the LED+ output of dimmable power supply circuit 400. The AC signal appearing at the ACL and ACN inputs of dimmable power supply circuit 400 can be reduced or increased using an external AC dimmer circuit. As an AC voltage at the ACL and ACN inputs increases or decreases, a voltage appearing at circuit node 215 smoothly increases or decreases along with it.

In control stage 213, a voltage that appears across zener diode 216 and a voltage that appears across a base-emitter junction of transistor 220 remains substantially constant as the voltage at circuit node 215 varies in accordance with the external AC dimming circuit. Thus, a voltage appearing at circuit node 221 also remains substantially constant in the presence of external dimming. As was indicated above, pin 8 of LED driver 230 is coupled to circuit node 221, and LED driver 230 uses the voltage at circuit node 221 to generate an internal operating voltage.

LED driver 230 generates a switching signal at pin 7 having a maximum duty cycle that is controlled by the reference voltage appearing at pin 1 of LED driver 230. Pin 1 of LED driver 230 is coupled to circuit node 225. As was explained above, resistor 224, resistor 226, and thermistor 227 function as a temperature-dependent voltage divider that sets the voltage appearing at circuit node 225 as some fraction of the voltage appearing at circuit node 215. The presence of external dimming increases or decreases a voltage that appears at circuit node 215.

Thus, there exists at least two ways in which the reference voltage at circuit node 225 can be altered and therefore at least two ways to control a maximum duty cycle of the switching signal that LED driver 230 generates at pin 7. First, external dimming increases or decreases the voltage at circuit node 215, which will result in an increase or decrease in the voltage at circuit node 225 according to the values of resistor 224, resistor 226, and thermistor 227. Second, a resistance of thermistor 227 is temperature-dependent, so temperature changes can alter a voltage at circuit node 225 even in the absence of external dimming.

Pin 7 of LED driver 230 is coupled to a control terminal, or gate, of transistor 234. Thus, pin 7 of LED driver 230 determines whether transistor 234 is in a conductive, or "on" state, or whether transistor 234 is in a non-conductive, or "off" state.

When the switching signal from pin 7 of LED driver 230 places transistor 234 in an "on" state, a conduction path is established in transistor 234, and current flows from circuit node 215, through capacitor 242, through inductor 232, through the conductive drain and source terminals of transistor 234, and through the parallel combination of resistors 236 and 238. The voltage across LED+ and LED− and the voltage across FAN+ and FAN− are equal to the voltage across capacitor 242. When transistor 234 is in an "on" state, diode 240 is reverse-biased, and no current flows through diode 240.

Inductor 232 of output stage 431 is a passive electrical component that stores energy in a magnetic field that is created by the current flowing in it. Electric current passing through inductor 232 creates a magnetic flux proportional to the current, and a change in the current creates a corresponding change in magnetic flux which, in turn, generates an EMF that opposes the change in current. The longer that current flows through inductor 232, the more energy that is stored, up to a limit that is determined by the particular inductance value H of inductor 232.

The duty cycle of the switching signal generated by LED driver 230 at pin 7 directly determines an amount of energy that is stored in inductor 232 by controlling an amount of time that transistor 234 is in a conductive state over one switching cycle of the signal from pin 7. One switching cycle is defined as one complete waveform of the signal, where the signal is assumed to be periodic. The duty cycle indicates an amount of time that the switching signal from pin 7 of LED driver 230 is at a logic one value during one switching cycle of the signal. For example, a duty cycle of 50% would indicate that the switching signal at pin 7 is at a "logic one" value, and transistor 234 is in an "on," or conductive state, for 50% of one switching cycle. Conversely, a 50% duty cycle also indicates that transistor 234 is in an "off," or non-conductive state, for 50% of one switching cycle.

Increasing the duty cycle of the switching signal from pin 7 of LED driver 230 increases the percentage of time that transistor 234 is "on" in one switching cycle, while decreasing the duty cycle of the switching signal from pin 7 of LED driver 230 decreases the percentage of time that transistor 234 is "on" in one switching cycle.

When the switching signal from pin 7 of LED driver 230 is in an "off" state, the conductive path through the conductive terminals of transistor 234 is closed down. At this time, the inductor 232 discharges its stored energy as current such that the current flows in a loop through inductor 232, diode 240, and capacitor 242. The voltage across LED+ and LED− and the voltage across FAN+ and FAN− are equal to the voltage across capacitor 242. When an AC input across terminals ACL and ACN is removed (power to dimmable power supply circuit 400 is turned off), resistor 244 functions to quickly discharge capacitor 244 and cause LED light engine 20 to switch off quickly.

If the AC input appearing across ACL and ACN is reduced, for example when dimmable power supply circuit is operated in conjunction with a dimmer circuit that functions to reduce the AC input at ACL and ACN, a voltage at node 215 is also reduced. Decreasing the voltage at node 215 results in a decrease in the voltage at node 225. The voltage at node 225 is tied to pin 1 of LED driver 230 and sets the maximum duty cycle of the switching signal that is generated by LED driver 230 at pin 7. Thus, decreasing the voltage at node 225 results in a reduced duty cycle from the switching signal that is output from pin 7 of LED driver 230.

As was explained above, a reduction in the duty cycle from the switching signal from pin 7 of LED driver 230 means that the percentage of time that transistor 234 is "on" relative to the time that is "off," is reduced, and thus less energy is stored in inductor 232 during the "on" periods. Less energy stored in inductor 232 during the "on" periods means less energy is discharged from inductor 232 during the "off" periods, reducing the voltage delivered to LED light engine 20. Less voltage delivered to LED light engine 20 results in less light being generated by LED light engine 20.

If an AC input voltage across ACL and ACN is again raised, a voltage at circuit node 215 rises as well, which brings up a reference voltage at circuit node 225. A rise in a reference voltage at node 225 causes LED driver 230 to increase a duty cycle of the switching signal that is output from pin 7. An increased duty cycle results in an increase in a percentage of time that transistor 234 is in the "on" state relative to a time that it is in the "off" state over one switching cycle, and thus more energy is stored in inductor 232 during the "on" states.

More energy stored in inductor 232 during the "on" states means a higher voltage is delivered to light engine 20. The higher voltage delivered to LED light engine 20 results in an increase of the light that is generated by LED light engine 20.

The FAN+ and FAN− outputs of dimmable power supply circuit 400 are coupled to the LED+ and LED− outputs, respectively. Thus, the description provided above for explaining the delivery of more or less energy to the LED light engine 20 as a duty cycle is controlled by a reference voltage at circuit node 225 applies equally to fan 34, that is coupled to the FAN+ and FAN− outputs. Thus, as LED light engine 20 is dimmed, less forced convection airflow is provided by fan 34. Conversely, as LED light engine 20 is brightened, more forced convection airflow is provided by fan 34. Compared to dimmable power supply circuit 200, which delivers a constant supply of forced convection airflow regardless of a dimming level, dimmable power supply circuit 400 conserves energy because an amount of forced convection airflow delivered is proportional to a dimming level.

Based on the explanation that was presented in the paragraphs above, dimmable power supply circuit 400 is capable of reducing and increasing the brightness of LED light engine 20 while delivering forced convection airflow from fan 34 that is attached to the FAN+ and FAN− outputs, where the forced convection airflow is proportional to an amount of dimming of LED light engine 20.

There are numerous advantages associated with dimmable power supply circuit 400. For example, the RC filter in conversion stage 201, including resistor 206 and capacitors 204, 208, provides a smooth dimming function. That is, the voltage node 215 is smoothly reduced in response to a reduction in the AC input at ACL and ACN. Another advantage is that power supply circuit 400 is non-insulated. That is, a lack of insulation between an AC input ACL and ACN and DC voltage outputs LED+ and LED−, FAN+ and FAN− leads to greater AC to DC conversion efficiency. For example, dimmable power supply circuit 400 has an efficiency of greater than 90%.

Dimmable power supply circuit 400 also does not utilize a transformer—only a single inductor coil 232 is present—resulting in reduced space requirements. Using only inductor 232 to drive LED light engine 20 also results in an excellent power factor—about 0.95 for dimmable power supply circuit 200.

Another advantage to dimmable power supply circuit 400 are the DC outputs FAN+, FAN− for driving fan 34 that deliver a forced convection airflow from fan 34 that is proportional to an amount of dimming of LED light engine 20. Additionally, power supply circuit 400 also includes thermistor 227, which provides over-temperature protection.

Figure 9:
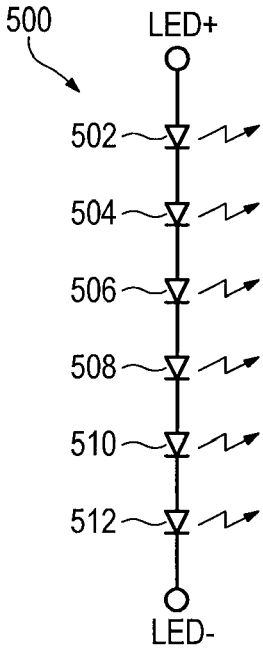
FIG. 9 is a circuit diagram illustrating an LED light engine suitable for implementing the LED light engine of FIG. 1.
Figure 10:
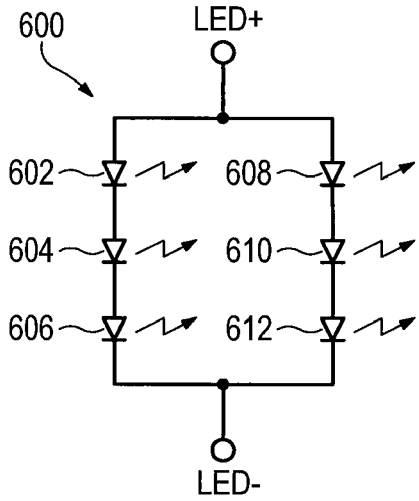
FIG. 10 is a circuit diagram illustrating another LED light engine suitable for implementing the LED light engine of FIG. 1.
Figure 11:
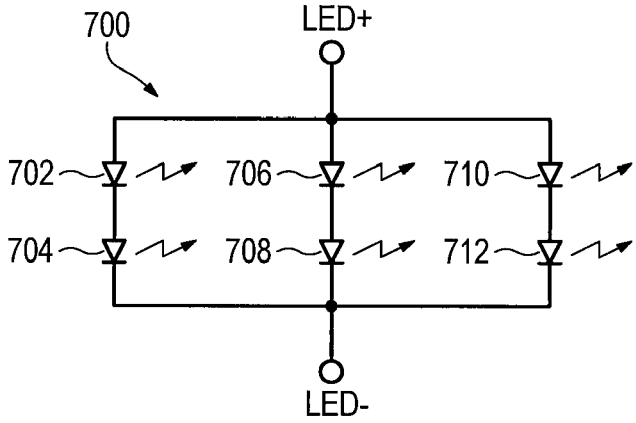
FIG. 11 is a circuit diagram illustrating still another LED light engine suitable for implementing the LED light engine of FIG. 1.

Now that several dimmable power supply circuits have been described in detail, for clarity and completeness it is appropriate to introduce a short discussion regarding possible configurations for suitable LED light engines that are suitable for implementing LED light engine 20 of FIG. 1. FIG. 9 is a circuit diagram illustrating an LED light engine 500 suitable for implementing the LED light engine 20 of FIG. 1. FIG. 10 is a circuit diagram illustrating another LED light engine 600 suitable for implementing the LED light engine 20 of FIG. 1. FIG. 11 is a circuit diagram illustrating still another LED light engine 700 suitable for implementing the LED light engine of FIG. 1.

Referring to FIG. 9, LED light engine 500 includes, but is not limited to, six LED 502, 504, 506, 508, 510, and 512. As illustrated in FIG. 9, each LED diode is series-connected between the LED+ output and LED− output of, for example, one of the dimmable power supply circuits 200, 300, or 400.

That is, an anode of light emitting diode 502 is coupled to the LED+ output, a cathode of light emitting diode 502 is coupled to an anode of light emitting diode 504, a cathode of light emitting diode 504 is coupled to an anode of light emitting diode 506, a cathode of light emitting diode 506 is coupled to an anode of light emitting diode 508, a cathode of light emitting diode 508 is coupled to an anode of light emitting diode 510, a cathode of light emitting diode 510 is coupled to an anode of light emitting diode 512, and a cathode of light emitting diode 512 is coupled to the LED− output.

Referring to FIG. 10, LED light engine 600 includes, but is not limited to, six LED 602, 604, 606, 608, 610, and 612. The light emitting diodes 602, 604, 606, 608, 610, and 612 are arranged in two series-connected groups of three diodes each, with each of the series-connected groups connected in parallel between the LED+ and LED− outputs.

That is, anodes of light emitting diodes 602 and 608 are coupled to the LED+ output, cathodes of light emitting diodes 602 and 608 are coupled to anodes of light emitting diodes 604 and 610, respectively, cathodes of light emitting diodes 604 and 610 are coupled to anodes of light emitting diodes 606 and 612, respectively, and cathodes of light emitting diodes 606 and 612 are coupled to the LED− output.

Referring to FIG. 11, LED light engine 700 includes, but is not limited to, six LED 702, 704, 706, 708, 710, and 712. The light emitting diodes 702, 704, 706, 708, 710, and 712 are arranged in three series-connected groups of two diodes each, with each of the series-connected groups connected in parallel between the LED+ and LED− outputs.

That is, anodes of light emitting diodes 702, 706, and 710 are coupled to the LED+ output, cathodes of light emitting diodes 702, 706, and 710 are coupled to anodes of light emitting diodes 704, 708, and 712, respectively, and cathodes of light emitting diodes 704, 708, and 712 are coupled to the LED− output.

While numerous other LED light engines suitable for implementing LED light engine 20 of FIG. 1 exist, LED light engines 500, 600, and 700 illustrate several possible ways in which design flexibility can be achieved for various AC input voltages for a dimmable power supply circuit that is to be used to implement LED light engine 100 of FIG. 1. Assuming that each of the light emitting diodes 502-512, 602-612, and 702-712 require approximately the same amount of voltage across an anode and cathode to function properly, LED light engine 600 would require only about half of the voltage required by LED light engine 500, while LED light engine 700 would require only about a third of the voltage required by LED light engine 500. For example, if LED light engine 500 required 21 V across the LED+ and LED− outputs, LED light engine 600 would require about 10.5 V and LED light engine 700, about 7 V.

Those of skill in the art will appreciate that a variety of different LED light engines, such as LED light engines 500, 600, or 700, exist that are suitable for using with different dimmable power supply circuits, such as dimmable power supply circuits 200, 300, and 400, in order to implement an LED lamp 100.

Several example embodiments were described in detail above with reference to the accompanying Figures. In the following paragraphs, some features of the example embodiments that were described above with reference to one or more Figures are succinctly stated for exemplary, non-limiting purposes. Any combination or sub-combination of these features can be present in one or more embodiments.

According to some embodiments, an LED lamp comprises a light engine including a plurality of LEDs and a power assembly, where the power assembly includes a socket disposed at one end of the power assembly, and a heat spreader plate disposed at another end of the power assembly opposite the socket. The light engine is mounted to the heat spreader plate. The power assembly additionally includes a power supply circuit that is electrically coupled to the socket and to the light engine, and a fan that is electrically coupled to the power supply circuit. The socket is configured to electrically couple the power supply circuit to an external electrical source. The LED lamp further comprises a heatsink that encircles the power assembly and that is thermally connected to the light engine. The heatsink includes a plurality of perforations, and the fan is arranged to draw air through the perforations in the heatsink.

According to some embodiments, an overall shape of the LED lamp conforms to an A shape as defined by ANSI. According to some other embodiments, the overall shape of the LED lamp conforms to an A19 shape as defined by ANSI.

According to some embodiments, the perforations in the heatsink have a length, and a width of the perforations in a direction perpendicular to the length of the perforations becomes narrower towards one end of the perforations and wider towards another end of the perforations. According to some embodiments, the power assembly further comprises a housing configured to enclose the power supply circuit. The housing includes perforations, and the fan is arranged to draw air through the perforations in the housing. In some embodiments, the heatsink comprises a stamped metal having a plurality of corrugations.

According to some embodiments, an LED lamp comprises a power assembly. The power assembly includes a fan and a power supply circuit. The power supply circuit is configured to convert an input voltage from the socket into a first output voltage for driving a plurality of LEDs. The power supply circuit is further configured to convert the input voltage into a second output voltage, and the power supply circuit is coupled to the fan such that the second output voltage drives the fan. The LED lamp further comprises a heatsink encircling the power assembly and thermally and mechanically coupled to the power assembly. The fan is arranged to force air through a plurality of perforations in the wall of the heat sink.

In some embodiments, the power supply circuit further comprises a first IC configured to maintain the second output voltage at a constant level as the input voltage varies. In some embodiments, the power supply circuit further comprises no more than one inductor coil. The no more than one inductor coil is coupled across the first output voltage.

In some embodiments, the power supply circuit further comprises a first capacitor coupled across the input voltage, and a second capacitor coupled in series with a first resistor, the series-coupled second capacitor and first resistor coupled across the input voltage. In some embodiments, the LED lamp further comprises a first IC configured to reduce the first output voltage in response to a reduction of the input voltage. In some embodiments, the power supply circuit further comprises a temperature sensor coupled to the first IC, the first IC configured to reduce the first output voltage in response to the temperature sensor detecting a threshold temperature.

In some embodiments, a method of manufacturing an LED lamp comprises stamping a sheet of material to form a cut-out having a plurality of perforations and a plurality of corrugations, and bending the cut-out to form a heatsink. The method further comprises providing a power assembly. The power assembly includes a power supply circuit configured to convert an AC input voltage into a first output voltage and a second output voltage. The power supply circuit is further configured to maintain the second output voltage at a constant level as the AC input voltage varies. The method further comprises thermally and mechanically coupling the power assembly to the heatsink by placing the power assembly of the LED lamp inside an empty space within the heatsink and in contact with the heatsink. The method further comprises electrically coupling a fan to the power supply circuit to receive the second output voltage. The fan is arranged to move air through the perforations in the heatsink.

In some embodiments, the power supply circuit does not include a transformer. In some embodiments, the method further comprises configuring the power supply circuit to reduce the first voltage in response to a reduction of the AC input voltage. In some embodiments, thermally and mechanically coupling the power assembly to the heatsink comprises contacting an outer circumferential surface of the power assembly with an inner circumferential surface of the heat sink. In some embodiments, stamping the sheet of material comprises stamping the sheet such that two of the perforations are disposed at a peak in the corrugations and two perforations are disposed at a trough in the corrugations.

In some embodiments, stamping the sheet of material further comprises stamping the sheet such that a first group of perforations is arranged around a first circumference of the heatsink. The perforations in the first group are uniformly spaced around the first circumference, and the first circumference is disposed adjacent to a first circular opening in the heatsink. Stamping the sheet of material further comprises stamping the sheet such that a second group of perforations is arranged around a second circumference of the heatsink. The perforations in the second group are uniformly spaced around the second circumference, and the second circumference is disposed adjacent to a second circular opening in the heatsink. The first circular opening is larger than the second circular opening.

According to some other embodiments, a method of manufacturing an LED lamp comprises stamping a sheet of material to form a cut-out, and joining an edge of the cut-out to another edge of the cut-out to form a heatsink having two circular openings. A diameter of one of the two circular openings is greater than a diameter of the other one of the two circular openings. The method further comprises positioning a power assembly of the LED lamp inside the heatsink such that the heatsink is thermally and mechanically coupled to the power assembly, and electrically coupling a fan to the power assembly. The fan is arranged to move air over the heatsink.

In some embodiments, stamping the sheet of material comprises stamping a thermally conductive sheet of material. The thermally conductive sheet of material comprises at least one selected from the group consisting of Cu, Al, graphite, and carbon composite material.

In some embodiments, stamping the sheet of material comprises corrugating the sheet of material such that the cut-out is bent into a plurality of folds. In some embodiments, stamping the sheet of material comprises cutting holes in the sheet of material to form a plurality of perforations in the cut-out.

In some embodiments, the fan is arranged to move air through the perforations in the heatsink. In some embodiments, a width of the perforations is no greater than about two millimeters.

While one or more embodiments have been described and illustrated in detail, the skilled artisan will appreciate that modifications and adaptations to those embodiments may be made without departing from the scope of the invention as defined and set forth in the following claims.

What is claimed is:

1. A light-emitting diode (LED) device, comprising:

a light engine including a plurality of LEDs;

a power assembly including a socket and a power supply circuit connected to the light engine; and a heatsink disposed around the power assembly and thermally connected to the light engine, the heatsink including a plurality of ridges and an opening formed through one of the ridges.

2. The LED device of claim 1, wherein the power supply circuit includes no more than two inductors that are not magnetically coupled to one another.

3. The LED device of claim 1, wherein the heatsink comprises a stamped metal including a first row of openings formed in a surface of the heatsink and a second row of openings formed in the surface of the heatsink offset from the first row of openings.

4. The LED device of claim 1, further including a fan that is electrically connected to the power supply circuit and arranged to draw air through the opening in the heatsink.

5. The LED device of claim 4, wherein the power supply circuit is configured to provide a voltage output to both the light engine and the fan.

6. The LED device of claim 5, wherein the power supply circuit includes a resistor connected across the voltage output.

* * * * *